US011680573B2

(12) United States Patent
Huang et al.

(10) Patent No.: US 11,680,573 B2
(45) Date of Patent: Jun. 20, 2023

(54) AIR PUMP FOR AN INFLATABLE PRODUCT AND AN INFLATABLE PRODUCT WITH A BUILT-IN AIR PUMP

(71) Applicant: BESTWAY INFLATABLES & MATERIAL CORP., Shanghai (CN)

(72) Inventors: Shuiyong Huang, Shanghai (CN); Wanbin Qiu, Shanghai (CN); Ruoxun Yin, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 382 days.

(21) Appl. No.: 16/904,497

(22) Filed: Jun. 17, 2020

(65) Prior Publication Data

US 2020/0400149 A1 Dec. 24, 2020

(30) Foreign Application Priority Data

Jun. 21, 2019 (CN) ..... 201920946721.X
Aug. 6, 2019 (CN) ..... 201921277471.1
Mar. 16, 2020 (CN) ..... 202020321256.3

(51) Int. Cl.
*F04D 25/06* (2006.01)
*A47C 27/08* (2006.01)
(Continued)

(52) U.S. Cl.
CPC ..... *F04D 25/06* (2013.01); *A47C 27/082* (2013.01); *B63B 7/085* (2013.01); *F04D 29/503* (2013.01); *A63H 33/00* (2013.01)

(58) Field of Classification Search
CPC ..... F04D 25/06; F04D 25/0673; F04D 25/08; F04D 25/084; F04D 29/601; F04D 29/48;
(Continued)

(56) References Cited

U.S. PATENT DOCUMENTS 7,198,076 B2 * 4/2007 Wu ..... F04D 25/084 141/10
8,235,684 B2 8/2012 Song
(Continued)

FOREIGN PATENT DOCUMENTS

WO 2017064553 4/2017

OTHER PUBLICATIONS

Extended European Search Report dated Oct. 12, 2020 (dated Oct. 12, 2020) issued on related European patent application 20180228.7 by the European Patent Office.

*Primary Examiner* — Woody A Lee, Jr.
*Assistant Examiner* — Brian O Peters
(74) *Attorney, Agent, or Firm* — Dickinson Wright PLLC

(57) ABSTRACT

An air pump is delineated for an inflatable product that can be selectively connected thereto. The inflatable product includes a shell located on a side wall. The shell includes an internal chamber for selective placement of the air pump and an air valve for selective communication with the air pump. When the air pump is located in the internal chamber it can be moved to switch between a first position and a second position. The air pump includes an air inlet and an air outlet such that the air inlet is in communication with the air valve in the first position to deflate the inflatable product and the air outlet is in communication with the air valve in the second position to inflate the inflatable product. The air pump can also be used externally via manual connection between the air inlet or the air outlet and other inflatable products.

18 Claims, 38 Drawing Sheets

(51) Int. Cl.
*B63B 7/08* (2020.01)
*F04D 29/50* (2006.01)
*A63H 33/00* (2006.01)

(58) Field of Classification Search
CPC ..... F04D 29/483; F04D 29/50; F04D 29/503; F04D 29/602; A47C 27/082–084; A47C 27/087; A47C 27/088; A47C 27/10; A47C 27/18
See application file for complete search history.

(56) References Cited

U.S. PATENT DOCUMENTS

2005/0079077 A1* 4/2005 Tsai ..... F04D 25/084 417/423.15
2017/0254337 A1 9/2017 Lau et al.

* cited by examiner

AIR PUMP FOR AN INFLATABLE PRODUCT AND AN INFLATABLE PRODUCT WITH A BUILT-IN AIR PUMP

CROSS-REFERENCE TO RELATED APPLICATIONS

This U.S. patent application claims priority to and the benefit of Chinese patent application number CN201920946721.X, filed Jun. 21, 2019, Chinese patent application number CN201921277471.1, filed Aug. 6, 2019, and Chinese patent application number CN202020321256.3, filed Mar. 16, 2020, the entire disclosures of which are hereby incorporated by reference.

BACKGROUND OF THE INVENTION

1. Field of the Invention

The present invention generally relates to an inflatable product and a corresponding air pump.

2. Related Art

This section provides background information related to the present disclosure which is not necessarily prior art.

Inflatable products are popular consumer items, for example, inflatable beds, inflatable mattresses, inflatable boats, and inflatable toys, are widely favored by consumers over their non-inflatable counterparts because they are light weight, foldable, portable, comfortable, etc. A component for use with an inflatable product is an air pump, which may present in a variety of forms that may include manual air pumps, hand-held electric air pumps, and built-in electric air pumps. Among this variety of air pumps, the built-in electric air pumps have become more commonly used due to their fast inflation and convenient use.

Built-in electric air pumps typically allow a user to switch between an inflation, a deflation, and a neutral state. However, in order to switch between states, these built-in electric air pumps are usually provided with air passage switching devices, and therefore have a tendency to include overly complicated structures, high manufacturing costs, and operational complications. Moreover, built-in air electric pumps are permanently fixed inside inflatable products, and only operation panels are exposed for users to operate, which is inconvenient for maintenance. Oftentimes, an entire inflatable product is needed to be replaced upon the malfunction of its associated build-in air pump. In addition, due to the permanent installation, built-in electric air pumps can only be used with a single inflatable product, limiting the application range and cost-effectiveness.

Consequently, there exists a need for an inflatable product and an associated air pump with an improved connection mechanism.

SUMMARY OF THE INVENTION

This section provides a general summary of the disclosure and should not be interpreted as a complete and comprehensive listing of all of the objects, aspects, features and advantages associated with the present disclosure.

According to one aspect of the present invention, an inflatable product is provided. The inflatable product comprises a side wall defining an inflation cell and a shell that is located on the side wall and extends into the inflation cell. The shell defines an internal chamber and an air valve, and the air valve is in fluid communication with the internal chamber and the inflation cell. An air pump is also provided and includes an air inlet and an air outlet, the air pump being located at least partially within the internal chamber. The air pump is moveable within the internal chamber between a first position, a second position, and a neutral position. When the air pump is in the first position, the air inlet is connected to the air valve. When the air pump is in the second position, the air outlet is connected to the air valve. When the air pump is in the neutral position, neither of the air inlet nor the air outlet are connected to the air valve.

According to another aspect of the present invention, an air pump assembly is provided. The air pump assembly comprises an air pump including a pump body that at least partially encloses a space and includes an air inlet and an air outlet for selective connection to a provided inflatable body. A pump cover is located in the pump body between the air inlet and the air outlet for dividing the space into an inlet space and an outlet space and also includes an opening. An impeller is located in the air outlet space and when it rotates, air enters the air inlet and is transferred through the inlet space through the opening to the outlet space and out of the pump body through the air outlet.

Further areas of applicability will become apparent from the description provided herein. The description and specific examples set forth in this summary are intended for purposes of illustration only and are not intended to limit the scope of the present disclosure.

BRIEF DESCRIPTION OF THE DRAWINGS

The drawings, as shown and described herein, are for illustrative purposes only of selected embodiments and are not intended to limit the scope of the present disclosure. The inventive concepts associated with the present disclosure will be more readily understood by reference to the following description, in combination with the accompanying drawings wherein.

Figure 23A:
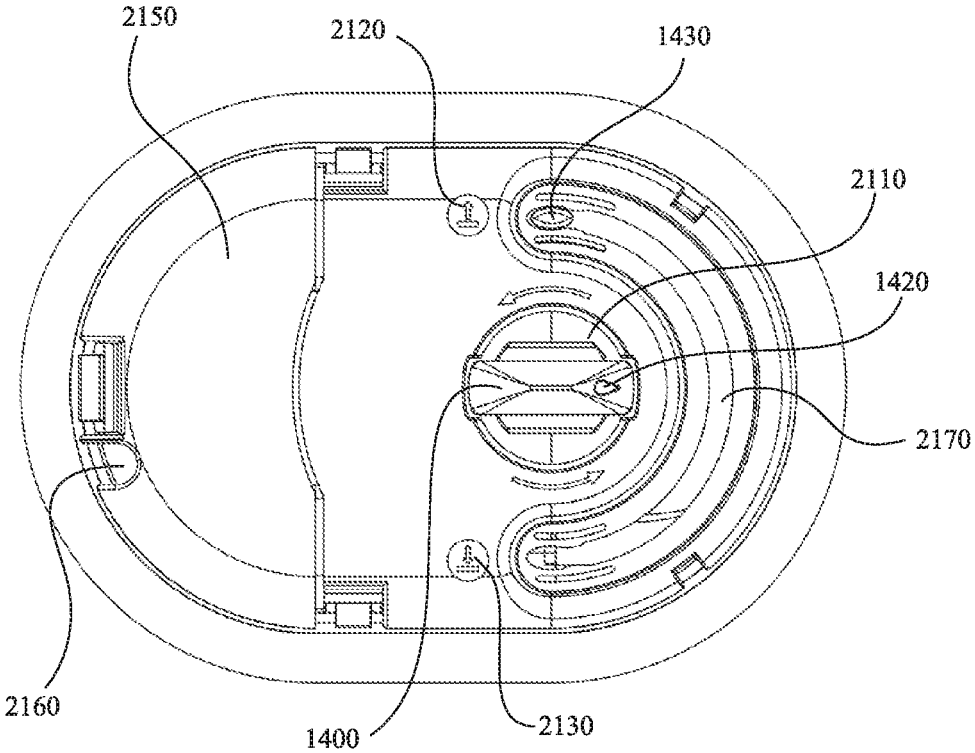
FIG. 23*a* is a top view of the connected air pump in the neutral position located adjacent to the inflation position.
Figure 23B:
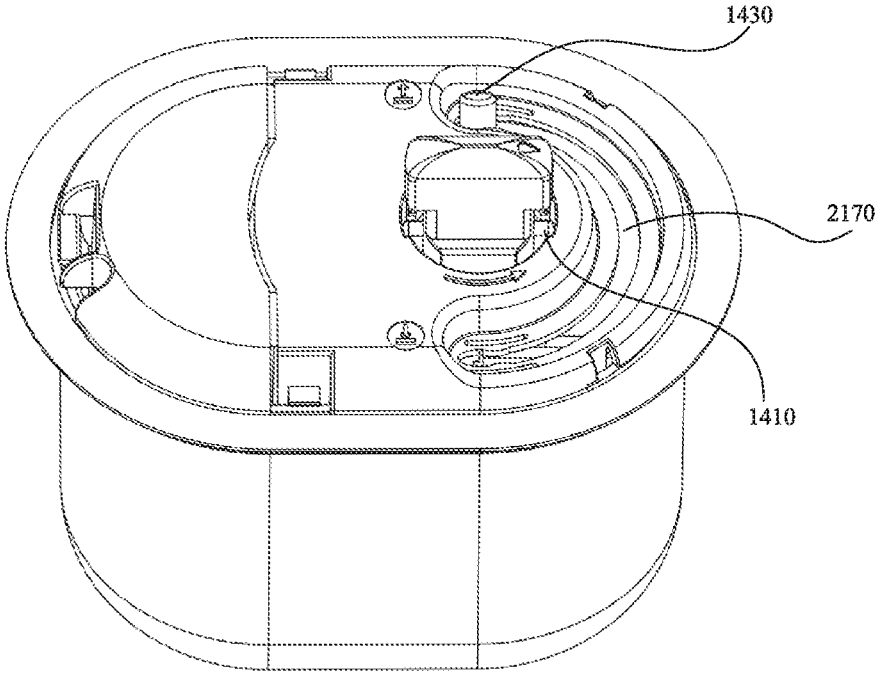
FIG. 23*b* is a top perspective view of the connected air pump in the neutral position located adjacent to the inflation position.
Figure 23C:
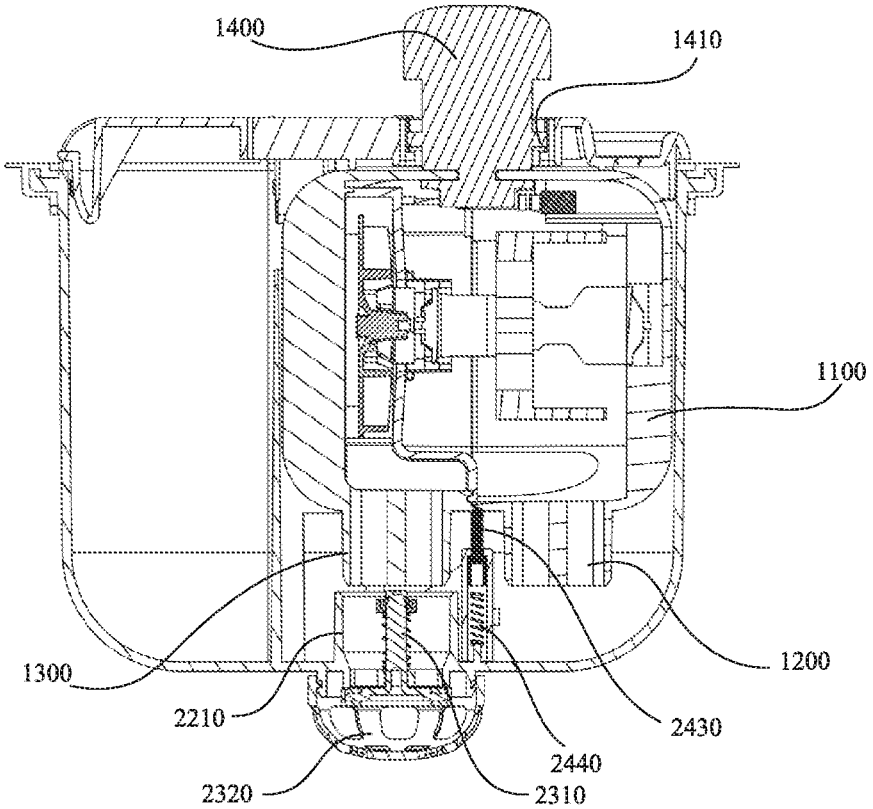
Figure 23D:
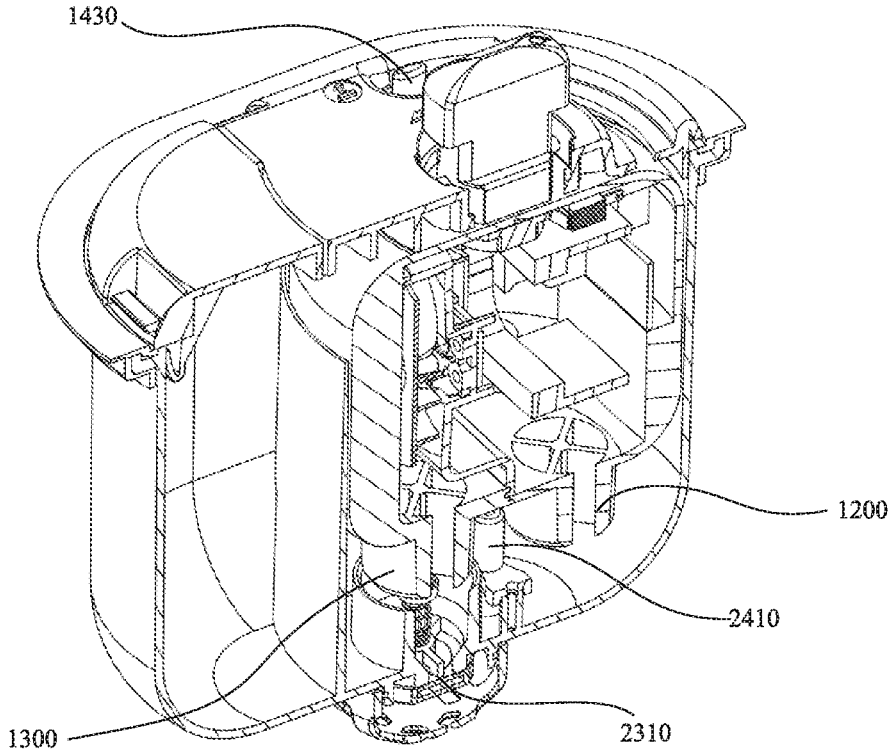
Figure 24A:
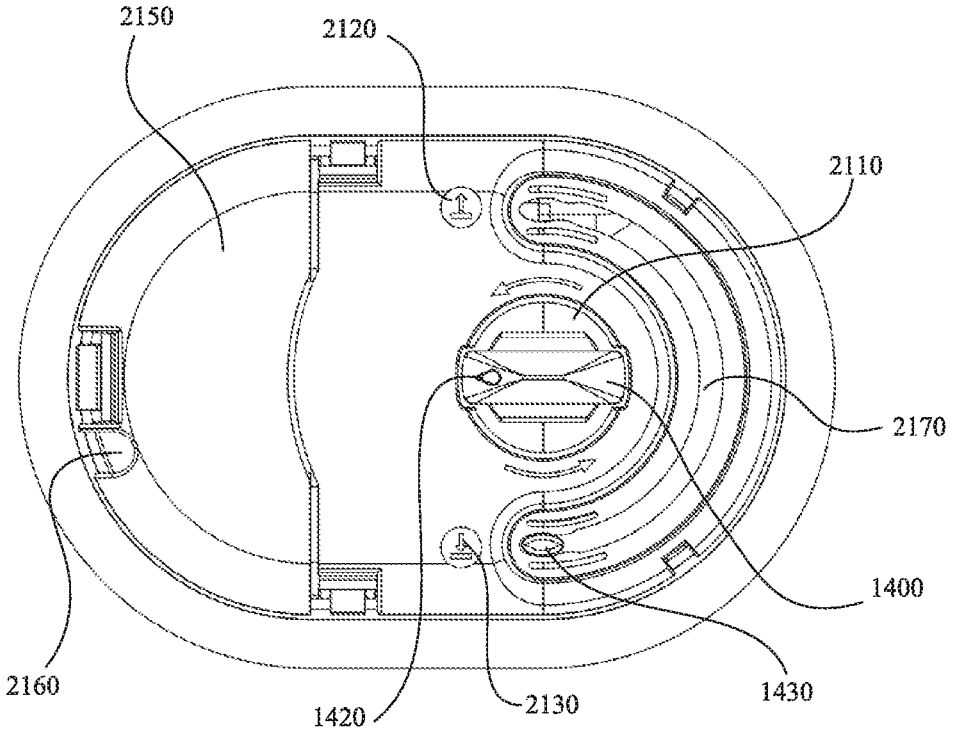
Figure 24B:
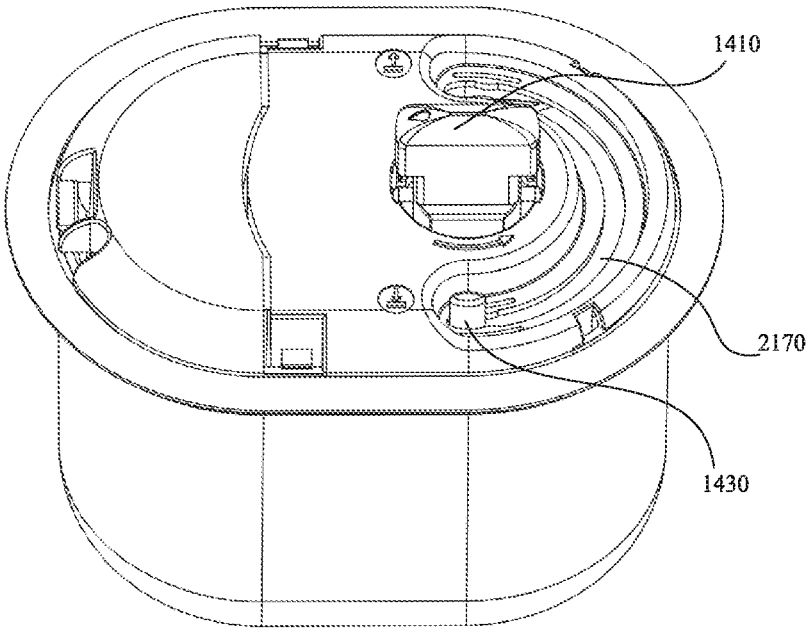
Figure 24C:
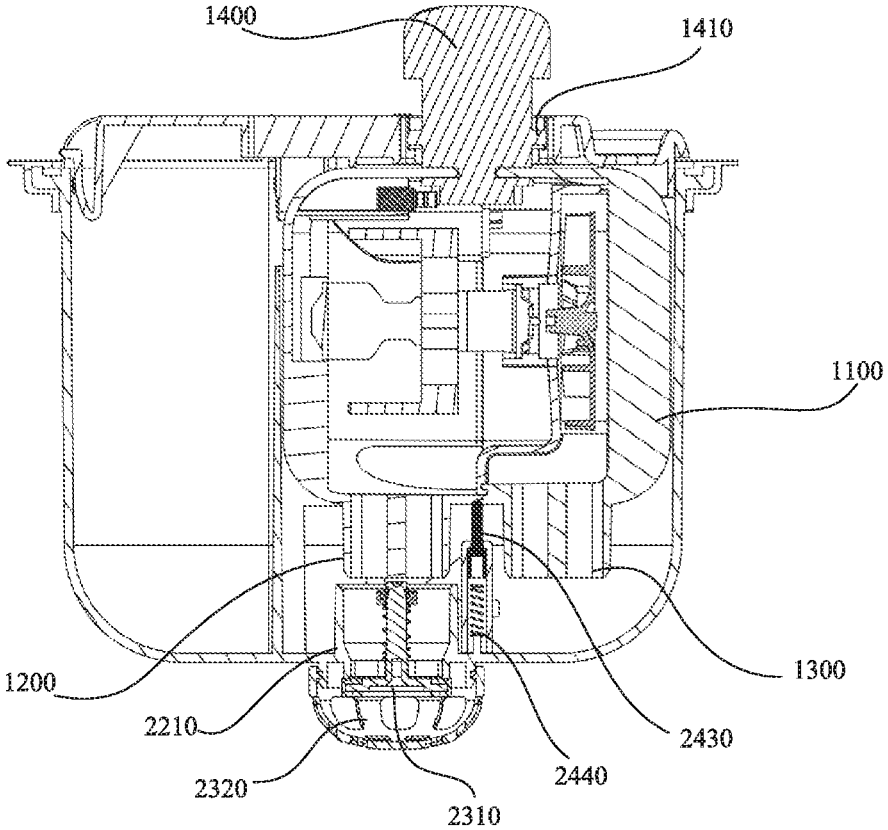
Figure 24D:
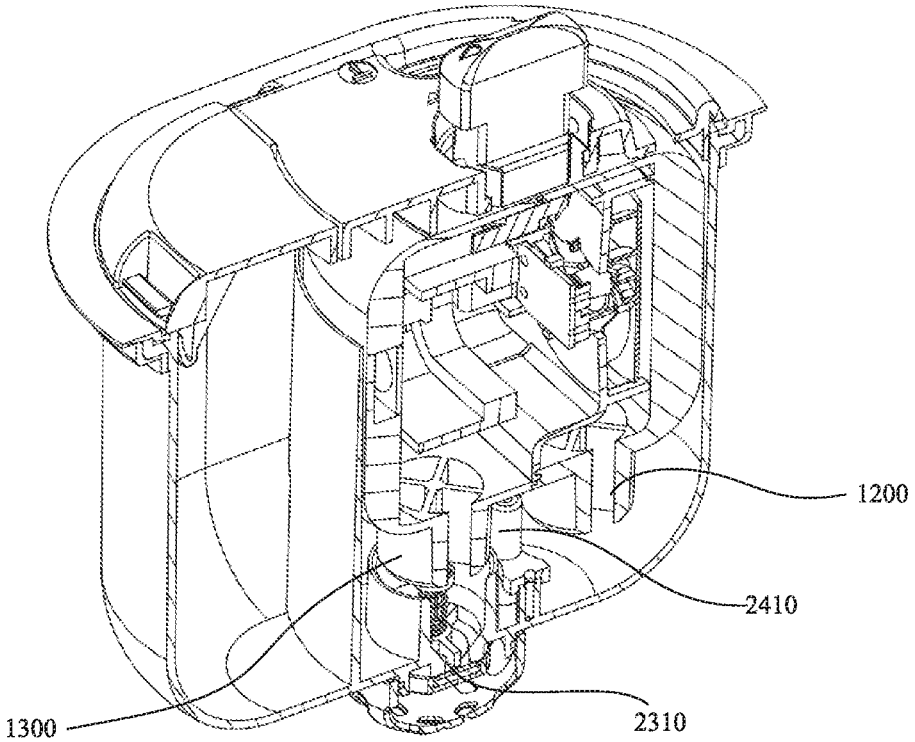
Figure 25A:
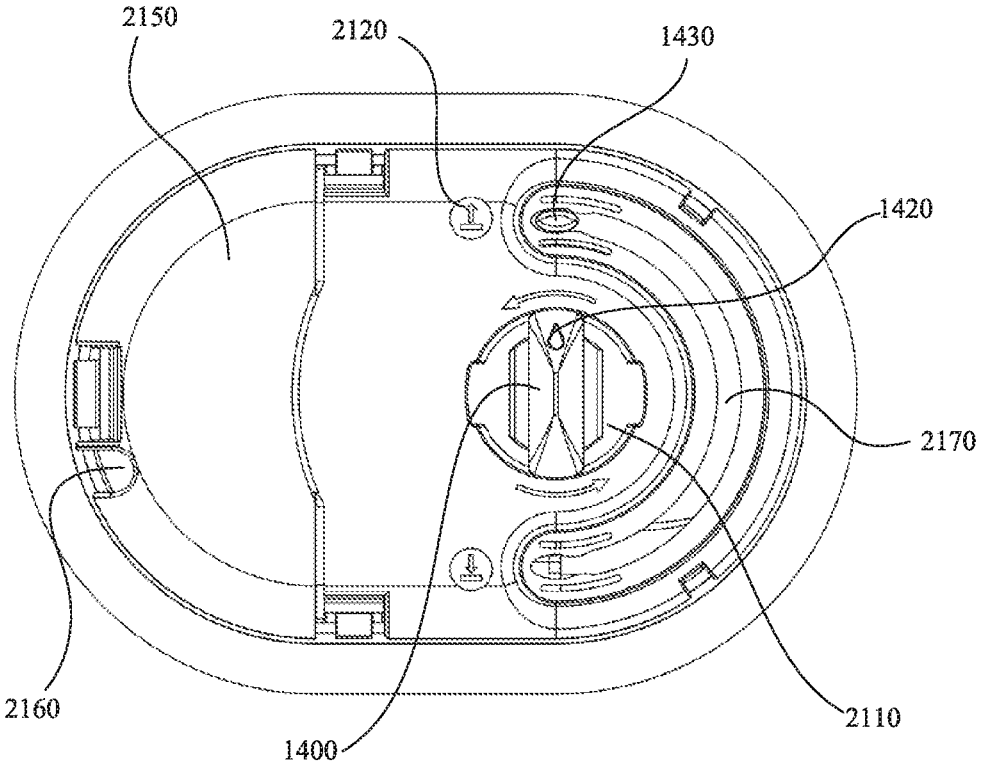
Figure 25B:
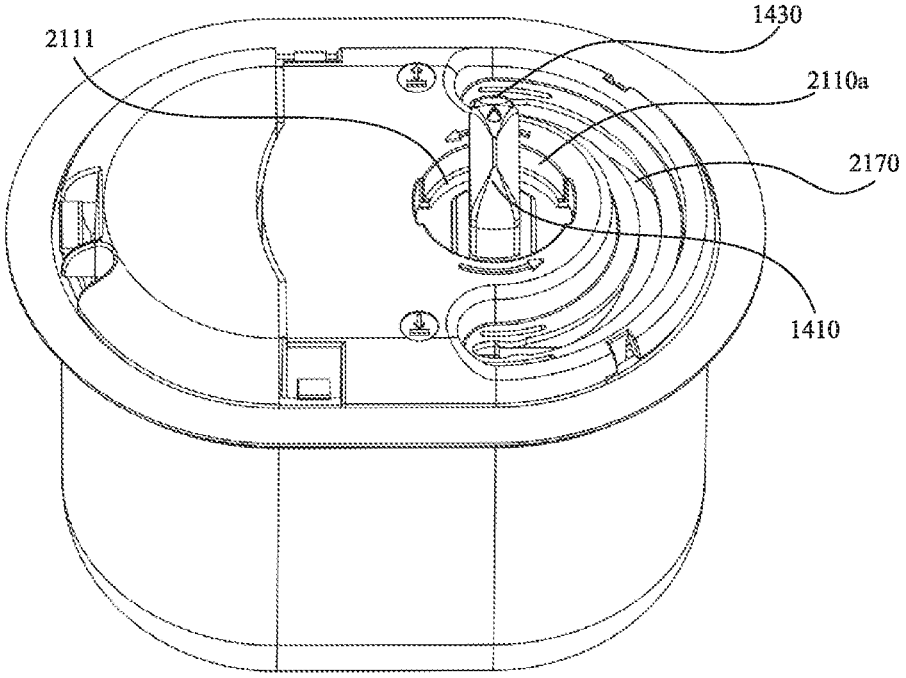
Figure 25C:
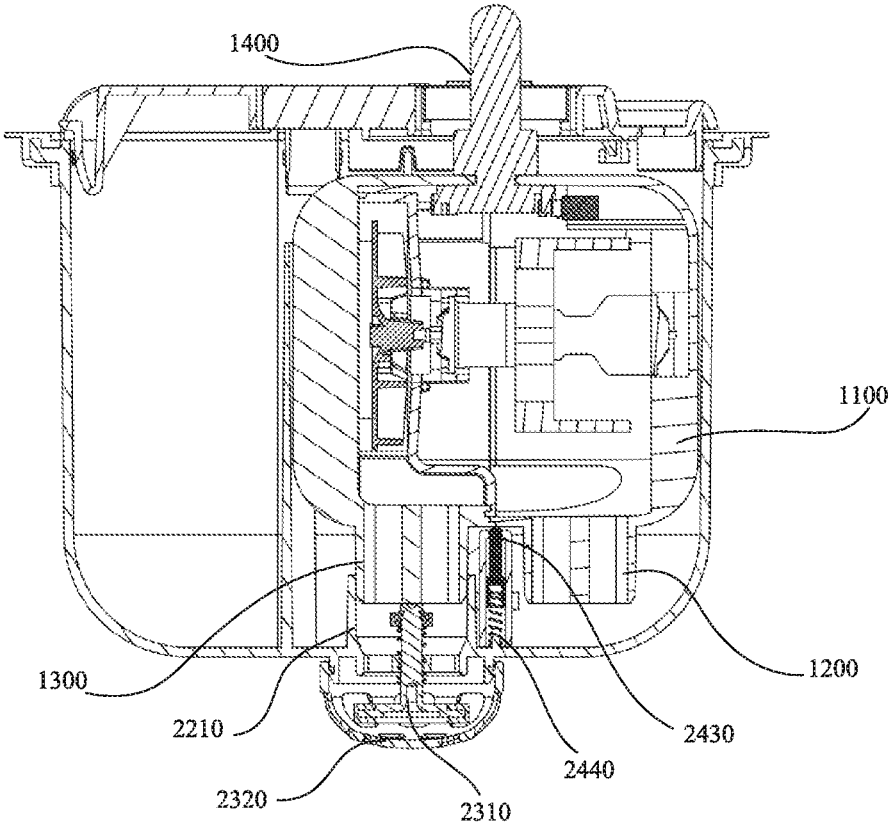
Figure 25D:
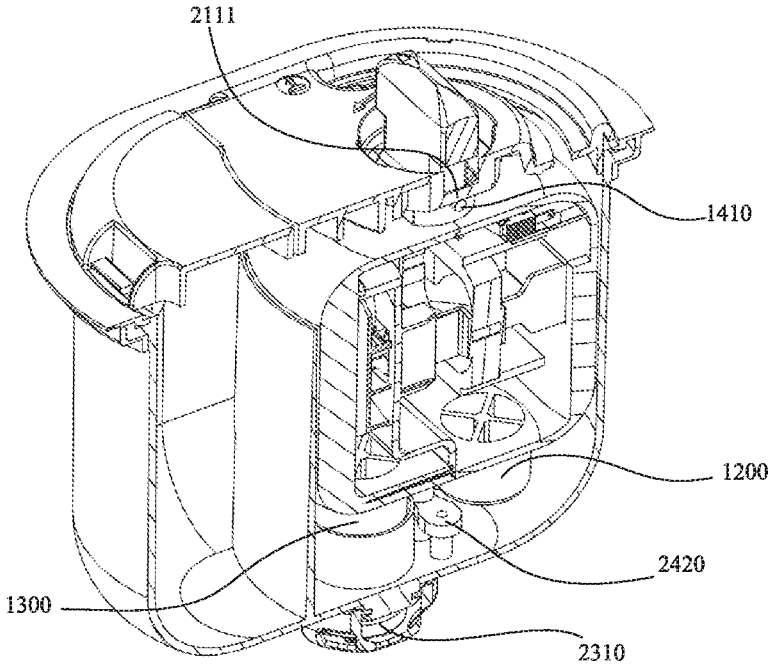
Figure 25E:
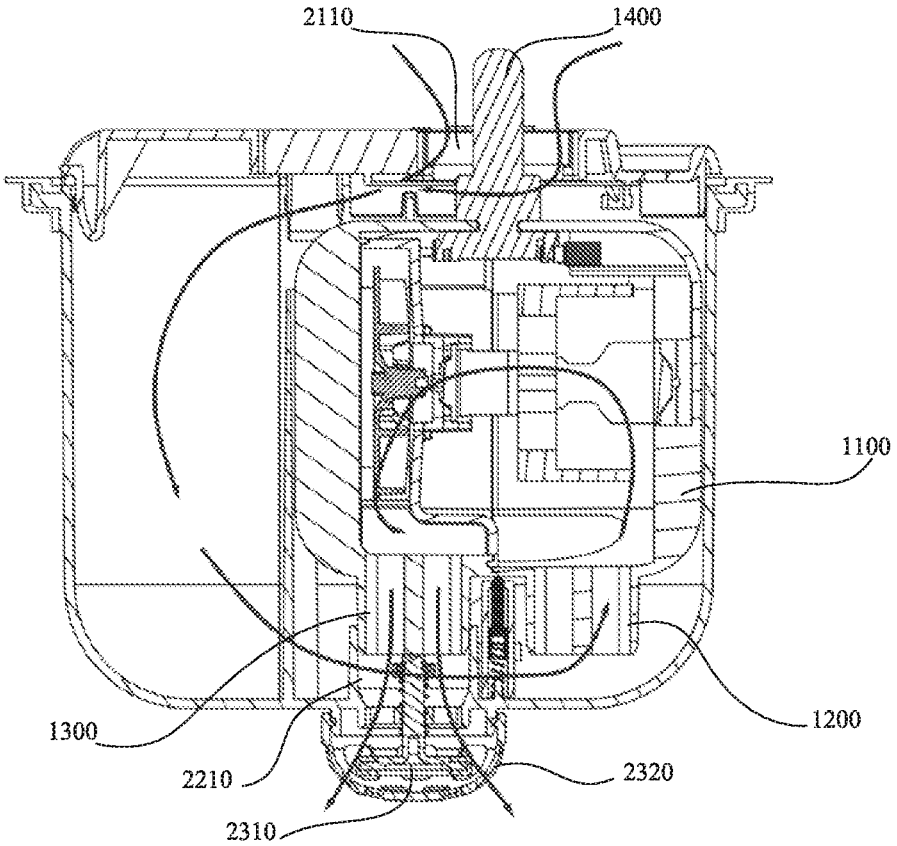
Figure 26A:
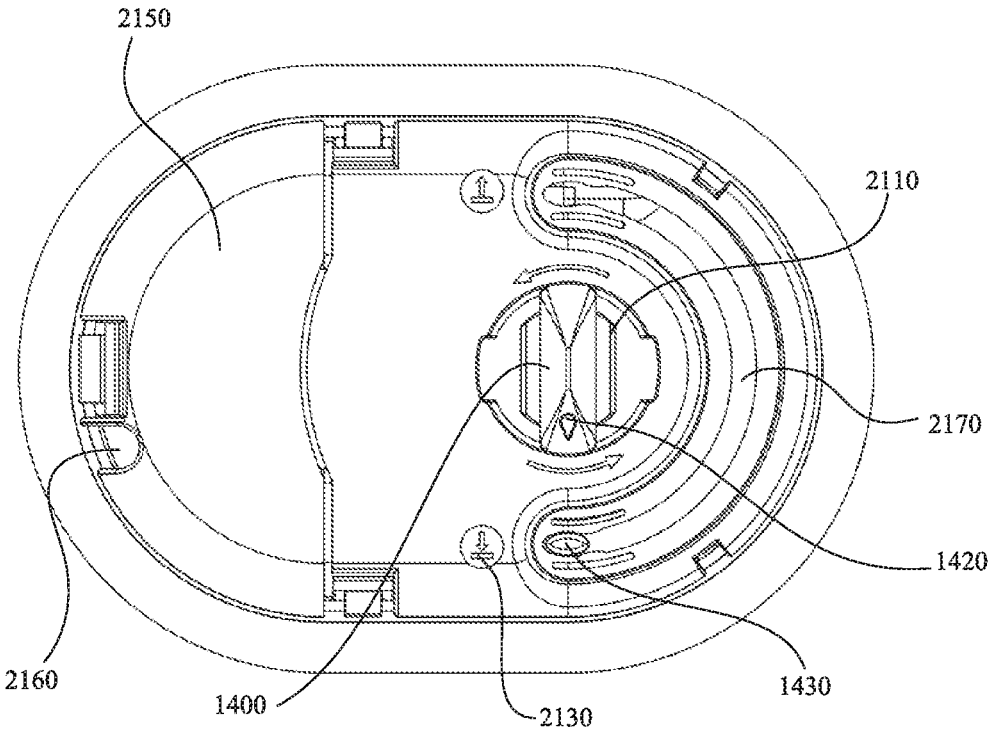
Figure 26B:
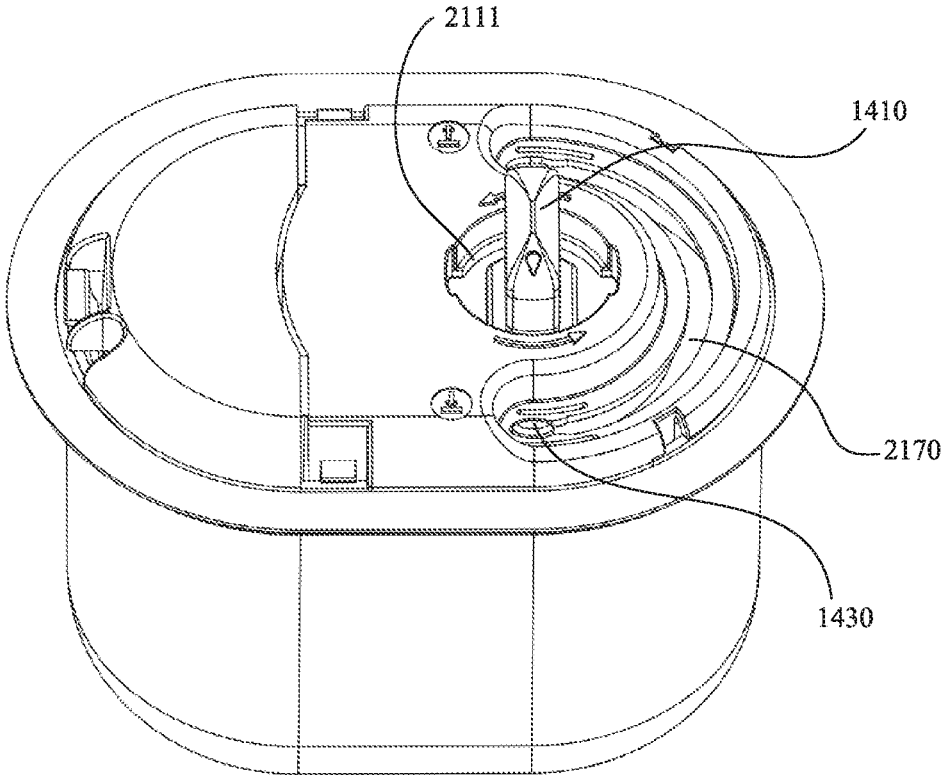
Figure 26C:
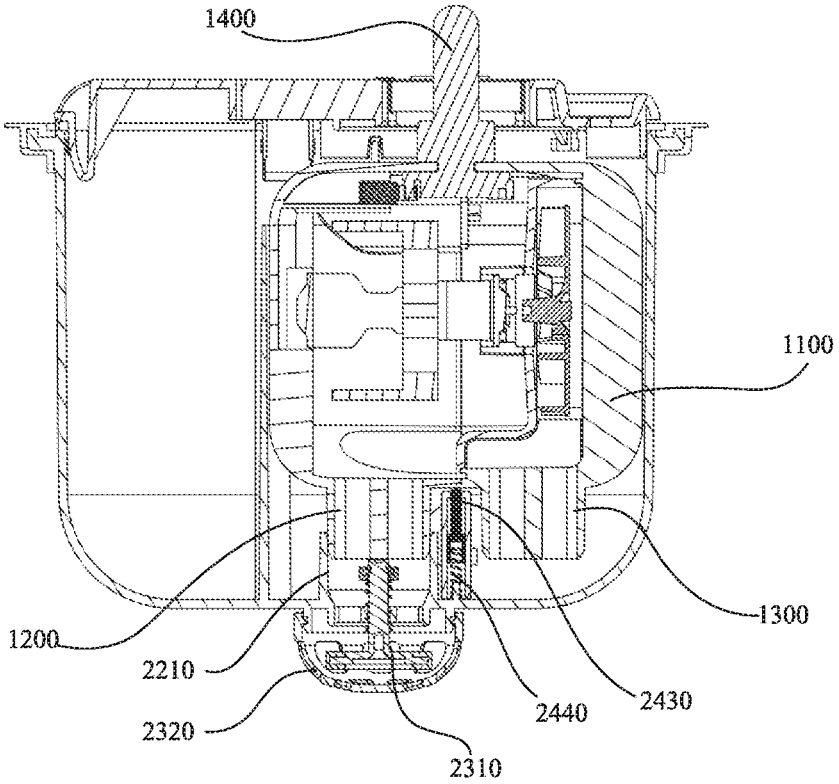
Figure 26D:
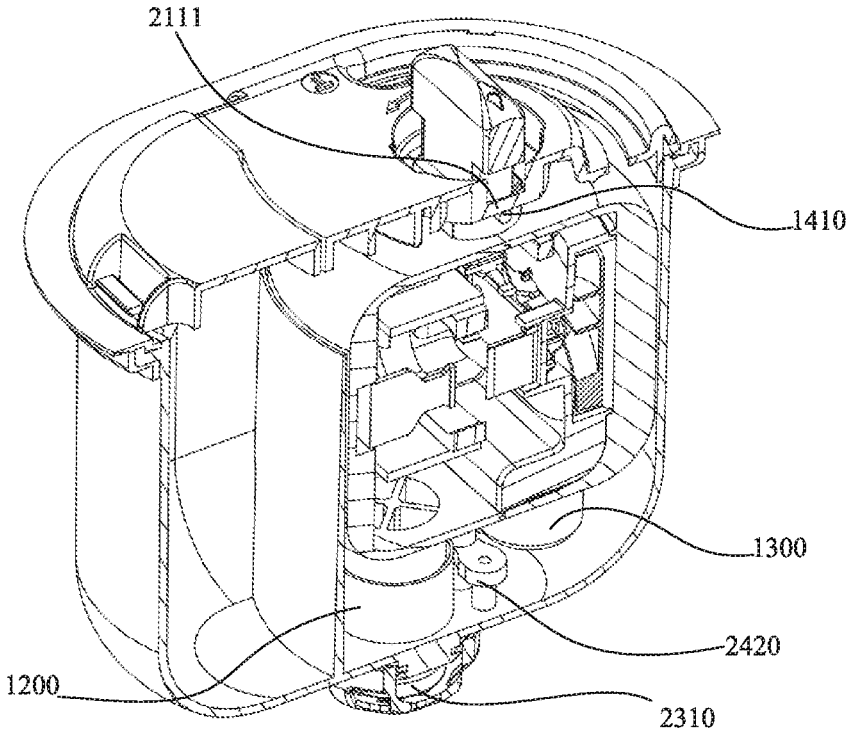
Figure 26E:
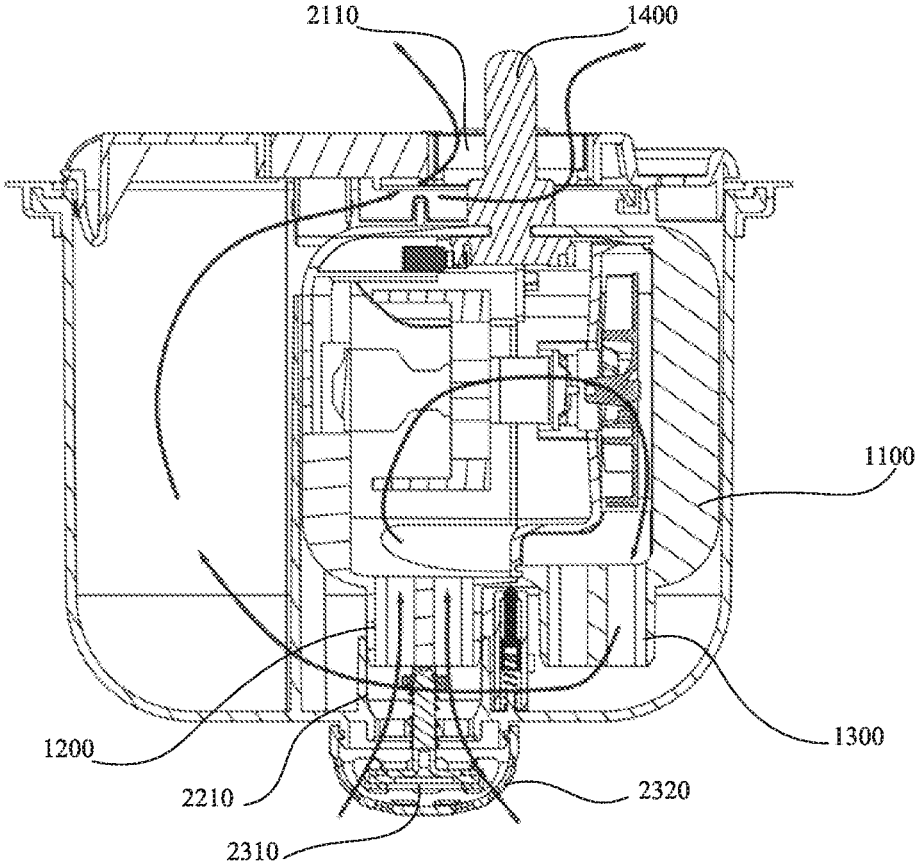
Figure 27A:
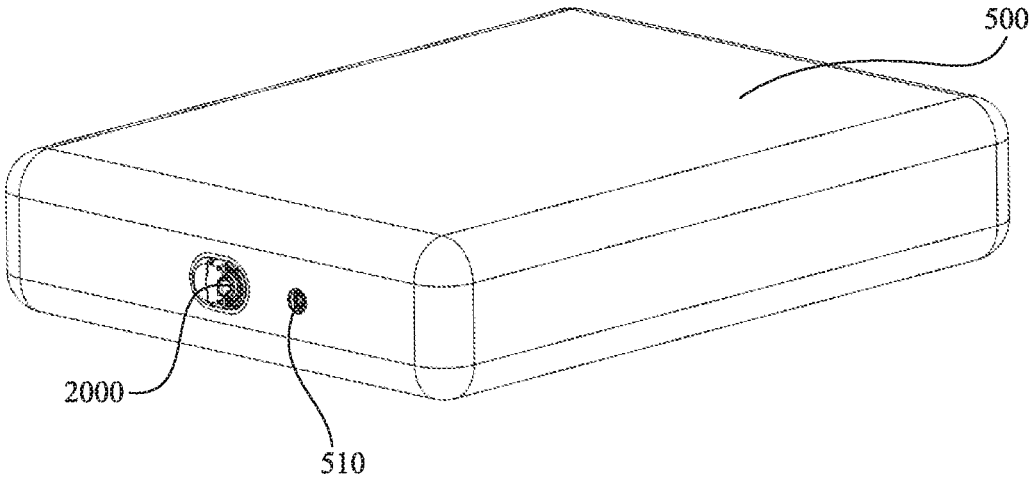
Figure 27B:
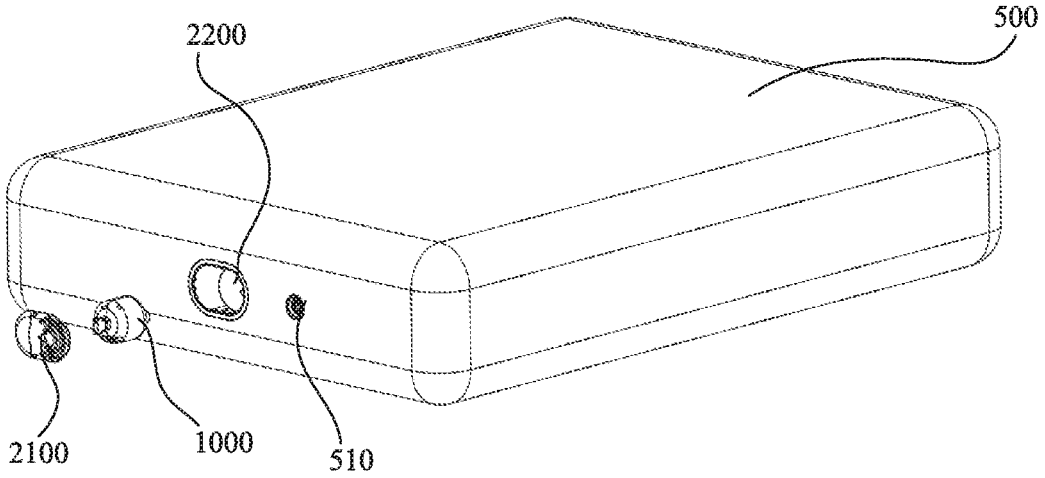

23*c* is a cross-sectional side view of the connected air pump in the neutral position located adjacent to the inflation position;

FIG. 23*d* is a cross-sectional top perspective view of the connected air pump in the neutral position located adjacent to the inflation position;

FIG. 24*a* is a top view of the connected air pump in the neutral position located adjacent to the deflation position;

FIG. 24*b* is a top perspective view of the connected air pump in the neutral position located adjacent to the deflation position;

FIG. 24*c* is a cross-sectional side view of the connected air pump in the neutral position located adjacent to the deflation position;

FIG. 24*d* is a cross-sectional top perspective view of the connected air pump in the neutral position located adjacent to the deflation position;

FIG. 25*a* is a is a top view of the connected air pump in the inflation position;

FIG. 25*b* is a top perspective view of the connected air pump in the inflation position;

FIG. 25*c* is a cross-sectional side view of the connected air pump in the inflation position;

FIG. 25*d* is a cross-sectional top perspective view of the connected air pump in the inflation position;

FIG. 25*e* is a cross-sectional view of the connected air pump in the inflation position illustrating the air flow path;

FIG. 26*a* is a is a top view of the connected air pump in the deflation position;

FIG. 26*b* is a top perspective view of the connected air pump in the deflation position;

FIG. 26*c* is a cross-sectional side view of the connected air pump in the deflation position;

FIG. 26*d* is a cross-sectional top perspective view of the connected air pump in the deflation position;

FIG. 26*e* is a cross-sectional view of the connected air pump in the deflation position illustrating the air flow path;

FIG. 27*a* is a perspective top view of the connected air pump located in the provided inflatable product; and FIG. 27*b* is an exploded view of the connected air pump for use with the provided inflatable product.

DETAILED DESCRIPTION OF THE INVENTION

The implementation and application of the embodiments will be discussed in detail below. However, it should be understood that the specific embodiments discussed only exemplarily describe the implementation and use of the present invention, and are not intended to limit the scope of the present invention. Throughout the description, the structural positions of various components, e.g., upper, lower, top, bottom, etc., are not absolute but relative description. The orientation expressions are appropriate when the various components are arranged as shown in the FIGS., but should change accordingly when the positions of the various components in the FIGS. change.

As used herein, "inflatable product" (or "inflatable body") includes, but is not limited to, an inflatable bed, an inflatable mattress, an inflatable pool, an inflatable boat, an inflatable raft, an inflatable toy, and other products that can be inflated.

Example embodiments will now be described more fully with reference to the accompanying drawings. In general, the subject embodiments are directed to an air pump for an inflatable product that is compact and thus facilitates attachment and detachment from the inflatable product. The structure and use of the air pump is simple. In use, a user aligns an air inlet or an air outlet of the air pump with an air valve of the inflatable product in order to switch inflation and deflation for the inflatable product.

When the air pump serves as a connected air pump of the inflatable product, the air pump can be placed within a shell fixed to a side wall of the inflatable product. The air pump moves within an internal chamber of the shell through cooperation of a knob switch of the air pump and an opening of the shell, thereby achieving switching between a first position where the location of an air inlet of the air pump generally matches (or overlaps) the position of and is connected to the air valve of the shell and a second position where the position of an air outlet of the air pump generally matches (or overlaps) the position of and is connected to the air valve of the shell. Accordingly, the air pump enables quickly switching between inflation and deflation of the inflatable product. It should be understood that the movement of the air pump comprises, but is not limited to, linear movement and rotary movement, wherein the internal chamber of the shell includes a path that may be parallel to the side wall of the inflatable product and a transverse path or direction that may be perpendicular or otherwise transverse to the side wall of the inflatable product and/or the path that may be parallel to the side wall. The linear movement of the air pump includes translation on the path that may be parallel to the side wall and translation along the transverse direction that is transverse to the path.

Figure 1A:
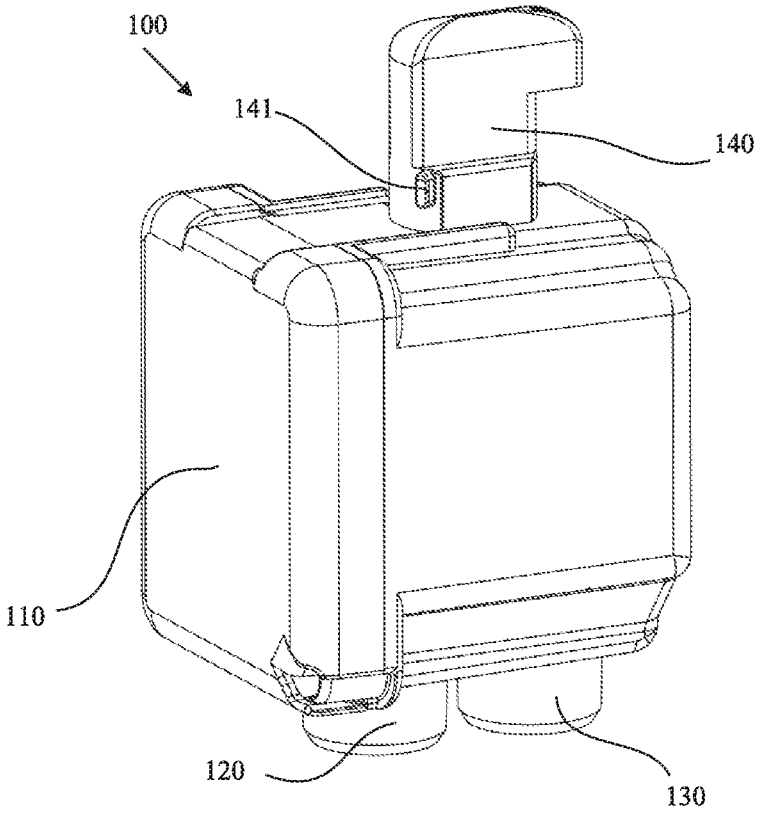
FIG. 1*a* is a front perspective of an air pump for an inflatable product according to an embodiment of the present invention.
Figure 1B:
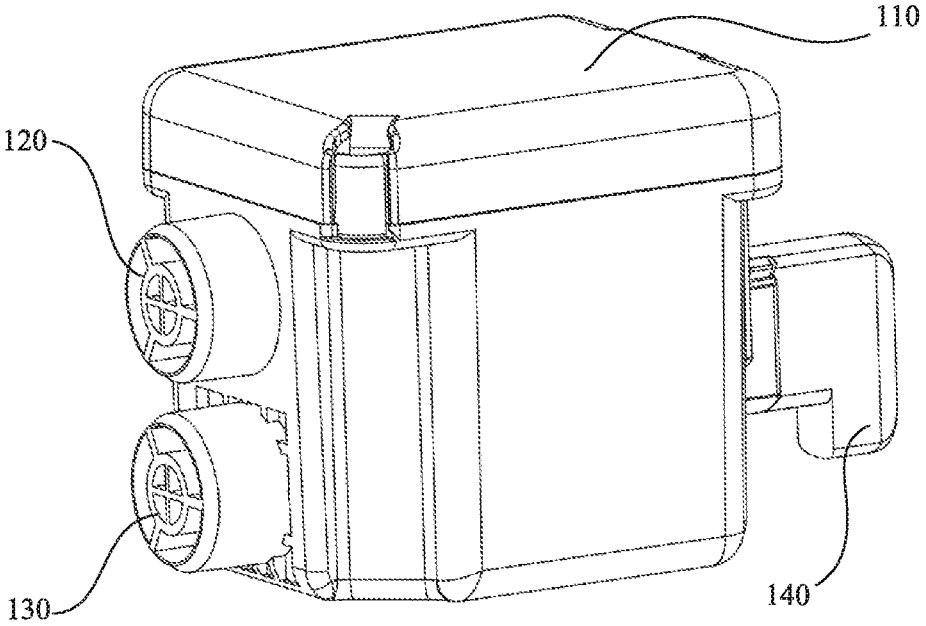
FIG. 1*b* is a perspective side view of the air pump illustrating an air inlet and an air outlet.
Figure 1C:
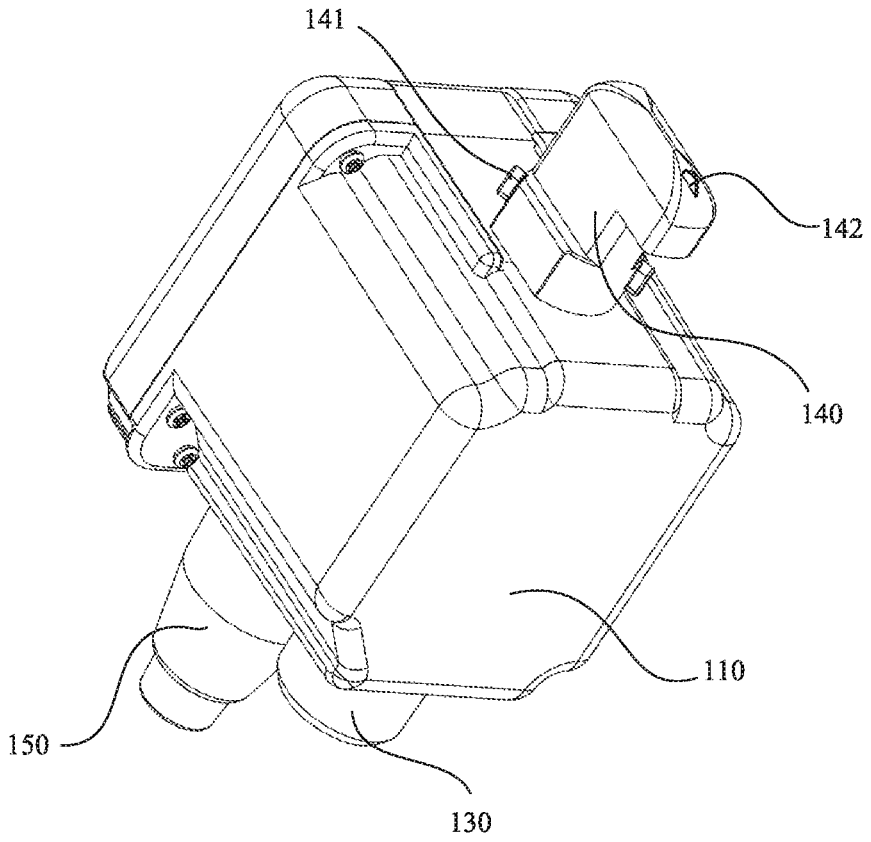
FIG. 1*c* is another front perspective of the air pump illustrating an inflatable product connector attached thereto.
Figure 2:
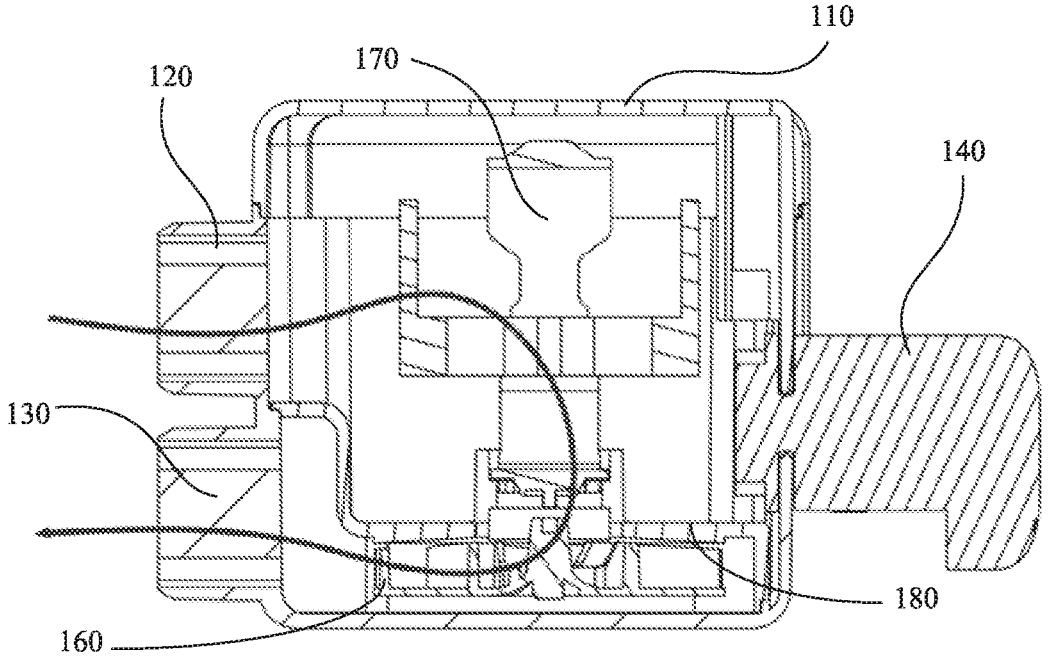
FIG. 2 is a cross-sectional view of the air pump illustrating an air flow path within the air pump.
Figure 3:
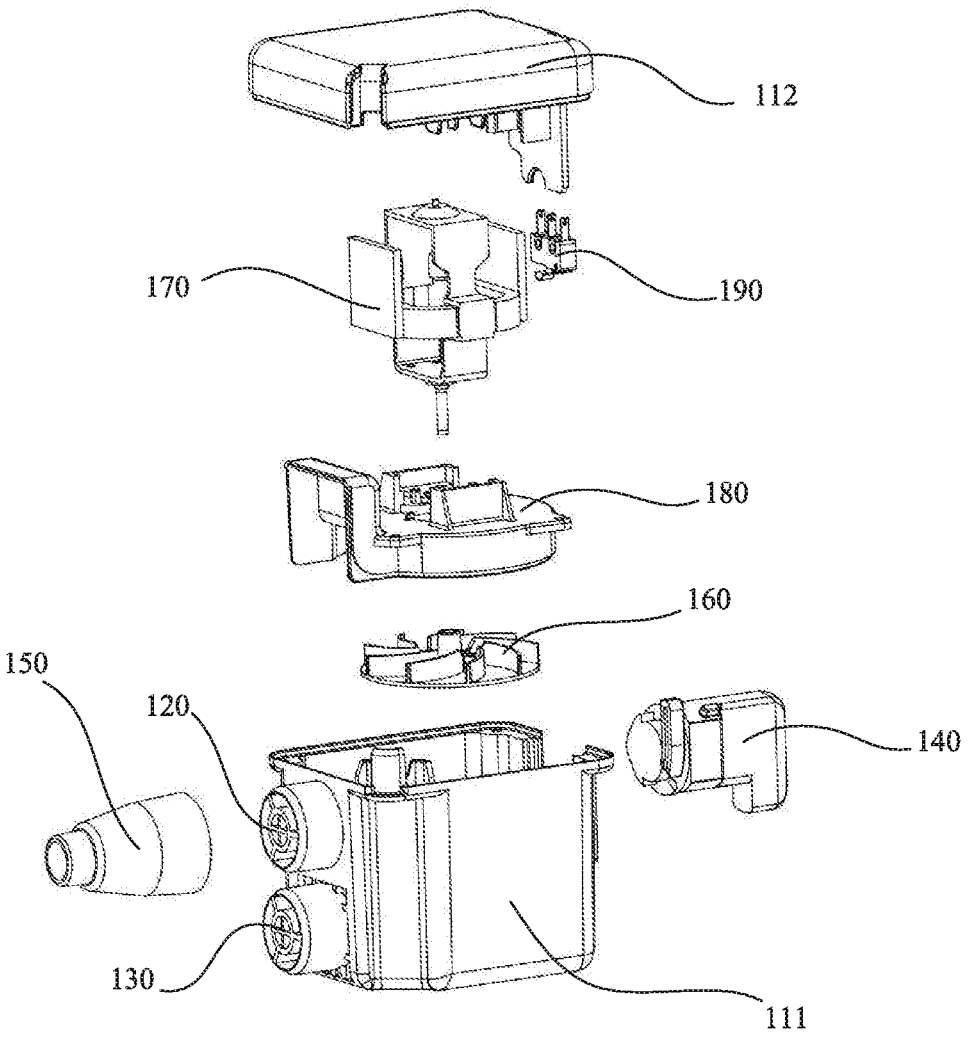
FIG. 3 is an exploded perspective view of the air pump.
Figure 4A:
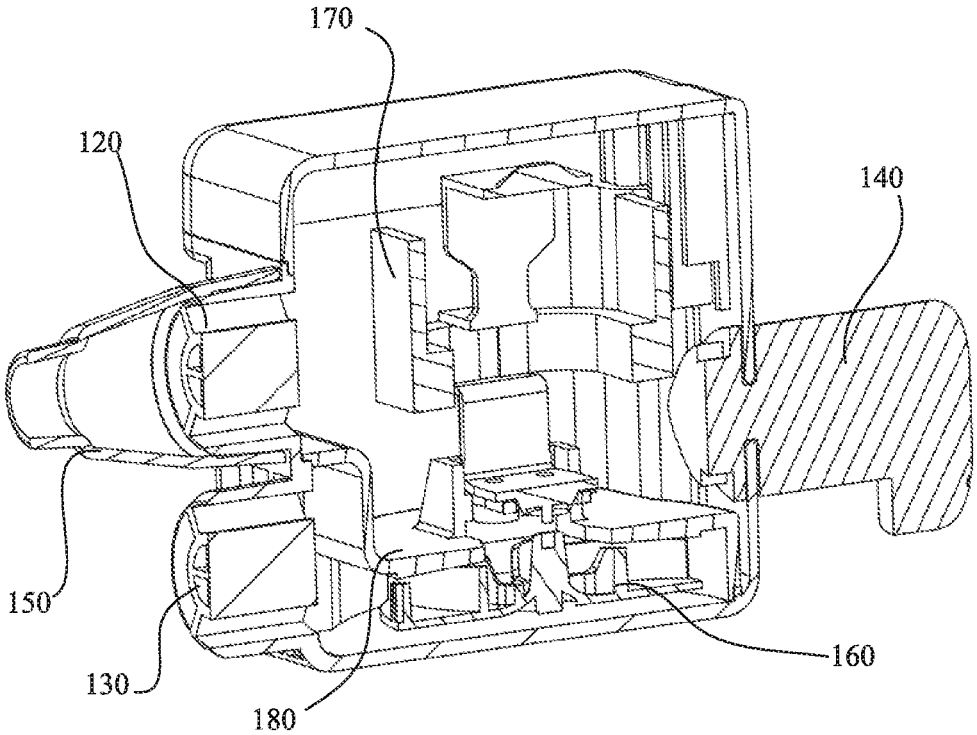
FIG. 4*a* is a cross-sectional perspective side view of the air pump with the inflatable product connector.
Figure 4B:
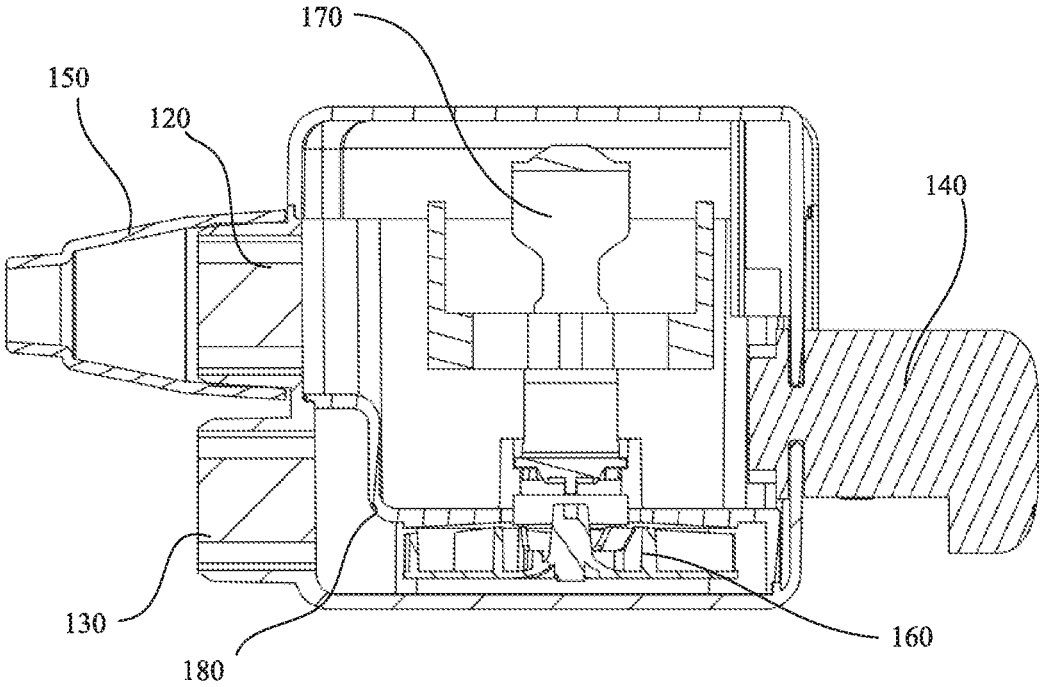
FIG. 4*b* is a cross-sectional side view of the air pump with the inflatable product connector.
Figure 4C:
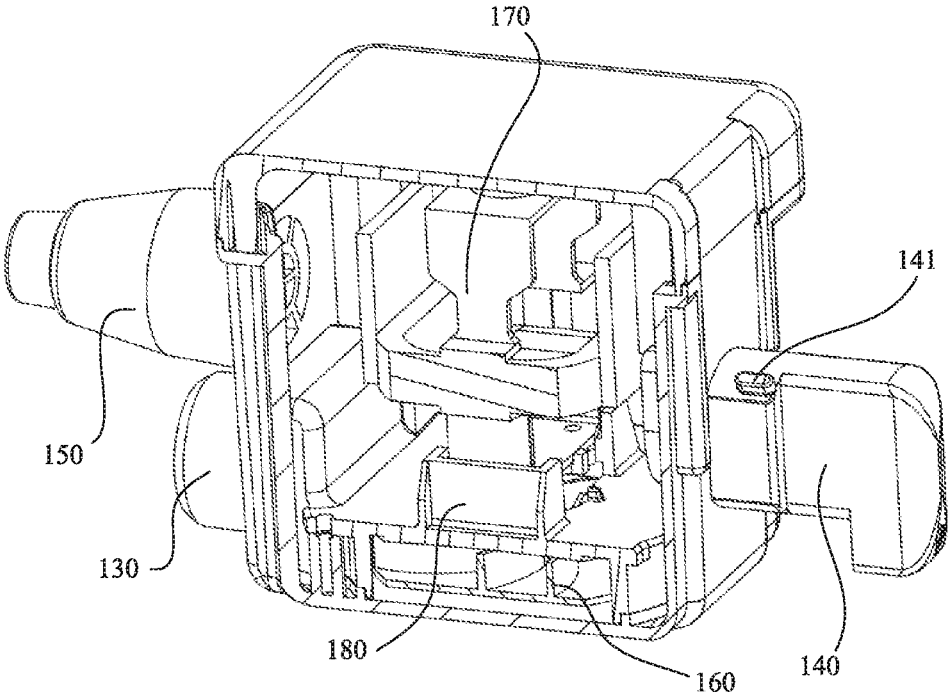
FIG. 4*c* is another cross-sectional perspective side view of the air pump with the inflatable product connector.

Referring initially to FIG. 1*a* to FIG. 4*c*, an air pump 100 for an inflatable product is illustrated according to an embodiment of the present invention. The air pump 100 comprises a pump body 110, and the pump body 110 may include a first pump body 111 and a second pump body 112 (FIG. 3) connected to each other. The first pump body 111 may include an air inlet 120 and an air outlet 130. A driving assembly is disposed in the pump body 110, as shown in FIG. 2 and FIG. 3. The driving assembly may include an impeller 160 and a driving motor 170. During operation, an output shaft of the driving motor 170 drives the impeller 160 to rotate and produce air pressure, thereby generating air flow from the air inlet 120 to the air outlet 130. As shown in FIG. 2, a pump cover 180 may also be disposed in the pump body 110 for fixing and separating the impeller 160 and the driving motor 170 so that when the driving motor 170 drives the impeller 160 to rotate, the air flow can be directed from the air inlet 120 to the air outlet 130 via the pump cover 180 and the impeller 160, as depicted by the arrow in FIG. 2. In other words, the pump cover 180 divides the inside of the pump body 110 into an air inlet cavity in communication with the air inlet 120, and an air outlet cavity in communication with the air outlet 130. In this way, when a connector 150 of the inflatable product is connected to the air inlet 120, the air pump 100 can deflate an inflation cell of the inflatable product, and when the connector 150 of the inflatable product is connected to the air outlet 130, the air pump can inflate the inflation cell of the inflatable product. It should be understood that although the joint of the connector 150 of the inflatable product for connection to the air pump 100 may have a fixed size, the joint for connecting the inflatable product can have different sizes according to the size requirements of a connector of the inflatable product that is to be inflated and deflated.

According to the present invention, the air pump 100 comprises a knob switch 140 extending from the pump body 110. The knob switch 140 can be moved along the path to turn on/off a driving circuit to switch on/off the driving assembly, so that the air pump 100 is switched between a shutdown state (i.e., a stop state or neutral position) and a start state (i.e., an inflation position or deflation position). As seen in FIG. 3, the driving assembly can also comprise a trigger switch 190, and the trigger switch 190 is electrically connected to the driving motor 170 to control switching the air pump 100 on and off. When the knob switch 140 is moved to contact the trigger switch 190, a start-up circuit of the driving motor 170 can be turned on to start the air pump 100, and when the knob switch 140 is moved to disengage from the trigger switch 190, the circuit is turned off to turn off the air pump 100.

The knob switch 140 may be provided with an indicator 142 for indicating the state or position of the air pump, such as a water drop shape exemplarily shown in FIG. 1*c*, or a similar sign such as an arrow. Correspondingly, for example, inflation and deflation signs and a stop sign may be provided on the surface of the pump body 110.

Figure 7A:
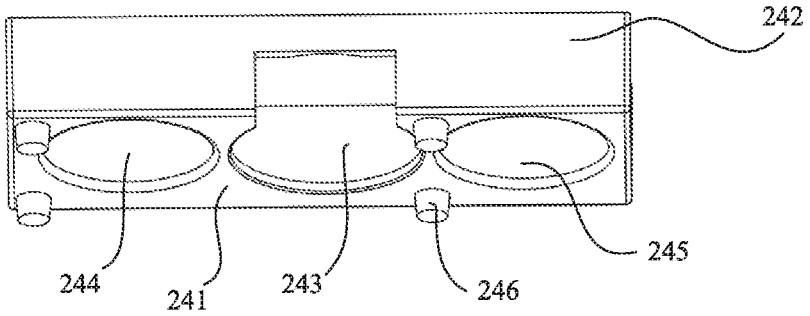
FIG. 7*a* is a bottom perspective view of a support component for the connected air pump according to an embodiment of the present invention.
Figure 7B:
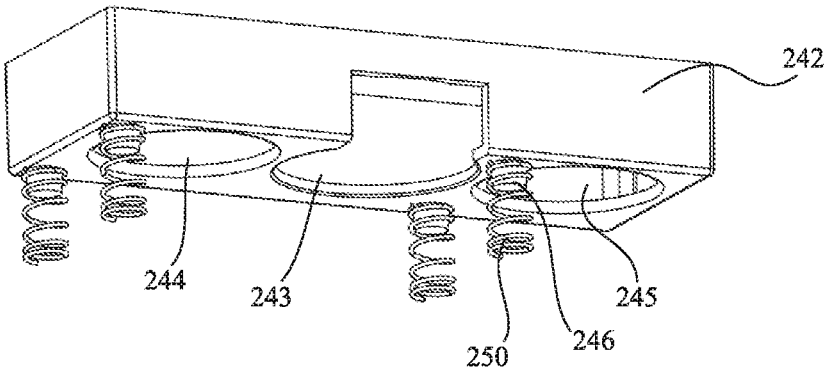
FIG. 7*b* is a bottom perspective view of the support component with an elastic member.
Figure 8:
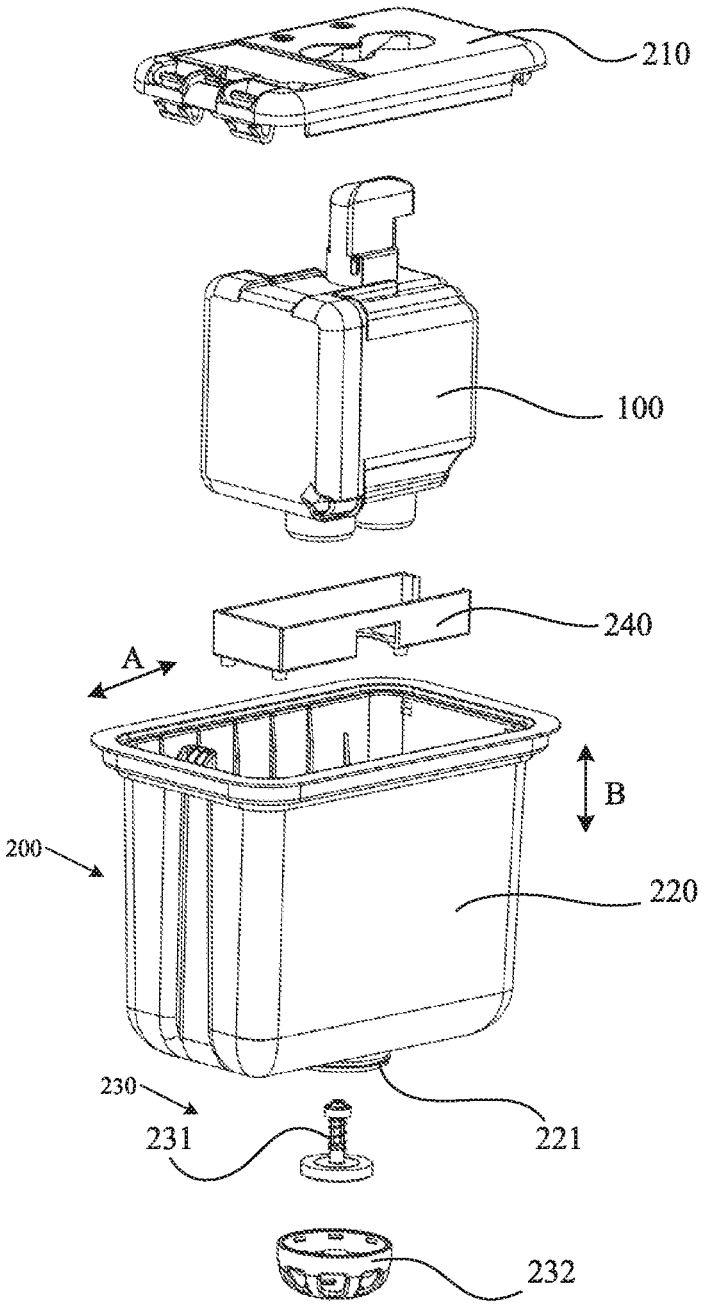
FIG. 8 is an exploded perspective view of the connected air pump shown in FIG. 5*a;*

FIG. 5*a* to FIG. 8 show an embodiment of the air pump 100 serving as a connected air pump. With reference to FIG. 8, the connected air pump 100 of the present invention comprises a shell 200 fixedly connected on a side wall of the inflatable product. In some embodiments, the shell 200 includes an openable upper cover 210 and a bottom portion 220 that are detachably connected to form an internal chamber. The air pump 100 can be detachably received in the internal chamber and is easy to remove and insert according to present needs. The bottom portion 220 is provided with a vent hole 221, and an air valve 230 is mounted on the vent hole 221 to prevent air leakage. The air valve 230 may comprise a valve plug 231 and a valve cap 232, and the valve cap 232 may be provided with a plurality of slots to facilitate air circulation. In this way, after the air pump 200 is detachably inserted in the bottom portion 220 of the shell 200, the air pump 100 is moved such that the position of the air inlet 120 or air outlet 130 thereof matches the position of the air valve 230 of the shell 200 to inflate or deflate the inflatable product.

In some embodiments, the air pump 100 can be moved along a transverse direction, represented by arrow B in FIG. 8, to connect the air outlet 130 or air inlet 120 to the air valve 230 of the shell 200, and optionally, the air pump 100 can be supported by a support component 240 (FIG. 8). When the pump body 110 of the air pump 100 is translated towards the air valve 230 along the transverse direction, i.e., along the arrow B in FIG. 8, the air pump 100 can press against and move the support component 240 towards the air valve 230. When the pump body 110 is moved away from the air valve 230 in the transverse direction, the support component 240 can be reset to facilitate moving the air pump 100 away from the air valve 230.

In some embodiments, the upper cover 210 of the shell 200 is provided with an opening 211 through which the knob switch 140 of the air pump 100 passes such that it can be held by a user. According to the present invention, when the knob switch 140 is moved towards the internal chamber of the shell 200 along the transverse direction, i.e., along the arrow B in FIG. 8, the air pump 100 is also moved along the transverse direction, and the air inlet 120 or the air outlet 130 may be selectively aligned and connected with the air valve 230 of the shell 200. In some embodiments, the opening 211 can be configured to limit knob switch 140 movement, such that the knob switch 140 can be rotated in the opening, and when the knob switch 140 has been moved and rotated into a desired position along the transverse direction, the knob switch 140 can be retained in place. Thus, after the knob switch 140 is moved into a desired position (e.g., an inflation state/position or a deflation state/position) along the transverse direction, the air pump 100 can be switched on/off by rotating the knob switch 140.

Figure 9A:
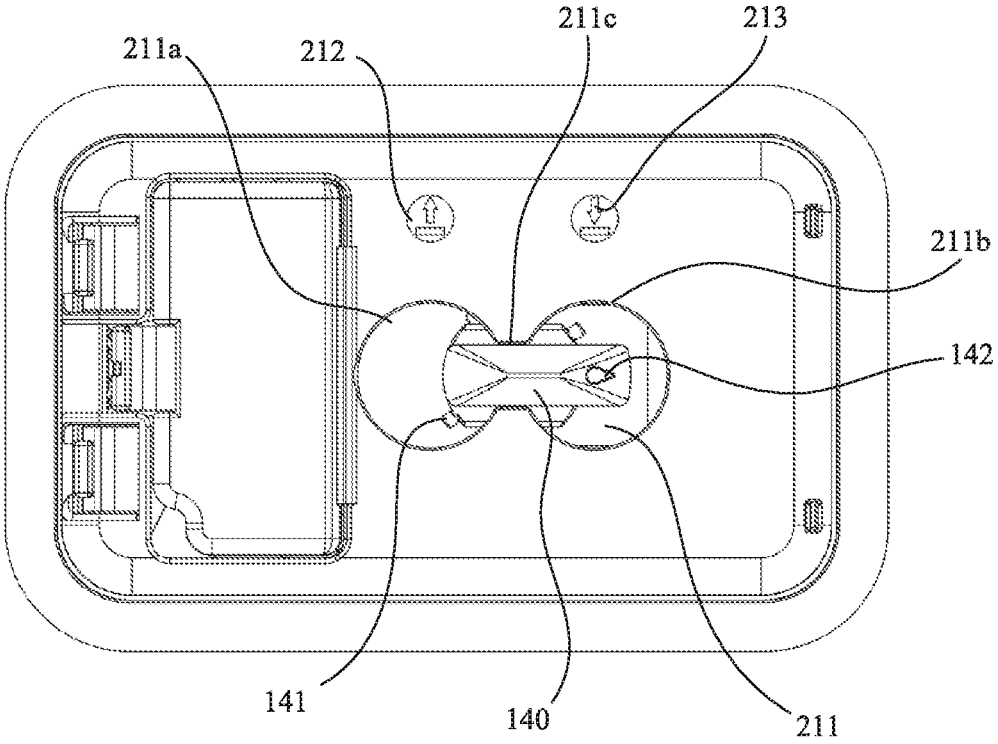
FIG. 9*a* is a top view of the connected air pump illustrating the upper cover.

In some embodiments, the opening 211 may be bounded by at least a first segment 211*a* and a second segment 211*b*, as shown in FIG. 9*a*, at least one of the first segment 211*a* and the second segment 211*b* being associated with a limit structure to retain the knob switch 140 once it has been moved into a desired position along the transverse direction, i.e., retaining the air pump 100 in its inflation position or its deflation position. In some embodiments, the first segment 211*a* may correspond to the first position or inflation state, and the second segment 211*b* may correspond to the second position or deflation state. As such, when the knob switch 140 is located in a portion of the opening 211 bounded by the first segment 211*a* and moved along the transverse direction, it is moved into the first position, and when the knob switch 140 is located in a portion of the opening bounded by the second segment 211*b* and moved along the transverse direction, it is moved into the second position. It should be appreciated that the first segment 211*a* could alternatively correspond to the second position and the second segment 211*b* could alternatively correspond to the first position, depending on the location of the air inlet 120 and air outlet 130.

In some embodiments, the opening 211 may further be bounded by a third segment 211*c*, as shown in FIG. 9*a*, wherein the knob switch 140 is in the neutral position and unable to move in the transverse direction when it is at least partially located along the third segment 211*c*. The knob switch 140 may be prevented from rotation when it is located in the third segment 211*c*. In other words, the third segment 211*c* may correspond to a stop state/neutral position. The third segment 211*c* may be arranged between the first segment 211*a* and the second segment 211*b* or on one side of the first segment 211*a* or the second segment 211*b* as will be described below.

As the knob switch 140 is moved along the transverse direction towards the inside of the internal chamber of the shell 200 and rotated, the air pump 100 is also moved along the transverse direction towards the air valve 230 at the bottom of the shell 200, and due to the limit structure for the knob switch 140, the air inlet 120 or the air outlet 130 of the pump body 110 moves into communication with the air valve 230 and is retained there to perform one of the inflation or deflation operations. When the knob switch 140 is moved along the transverse direction towards the outside of the internal chamber of the shell 200 and rotated in an opposite direction, the air pump 100 becomes dislocated and moved towards the upper cover 210, away from the air valve 230 of the shell 200 to disconnect the air inlet 120 or the air outlet 130 from the air valve 230. This means that in this embodiment, the air pump 100 cannot be started by means of movement of the knob switch 140 in only the transverse direction. The air pump 100 can also not be started by mere rotation of the knob switch 140 without also moving along the transverse direction. Thus, when the knob switch 140 is moved along the transverse direction towards the internal chamber of the shell 200 and rotated, the knob switch 140 is limited by virtue of the limit structure. The air pump 100 is synchronously moved along the transverse direction towards the bottom of the shell 200. Conversely, when the knob switch 140 is reversely rotated, it becomes dislocated and simultaneously moved along the transverse direction towards the upper cover 210 of the shell 200 to cause the pump body 110 to move towards the upper cover 210, thus stopping the driving motor 170. This helps to prevent unintended inflation or deflation caused by operation of the knob switch 140.

Figure 10A:
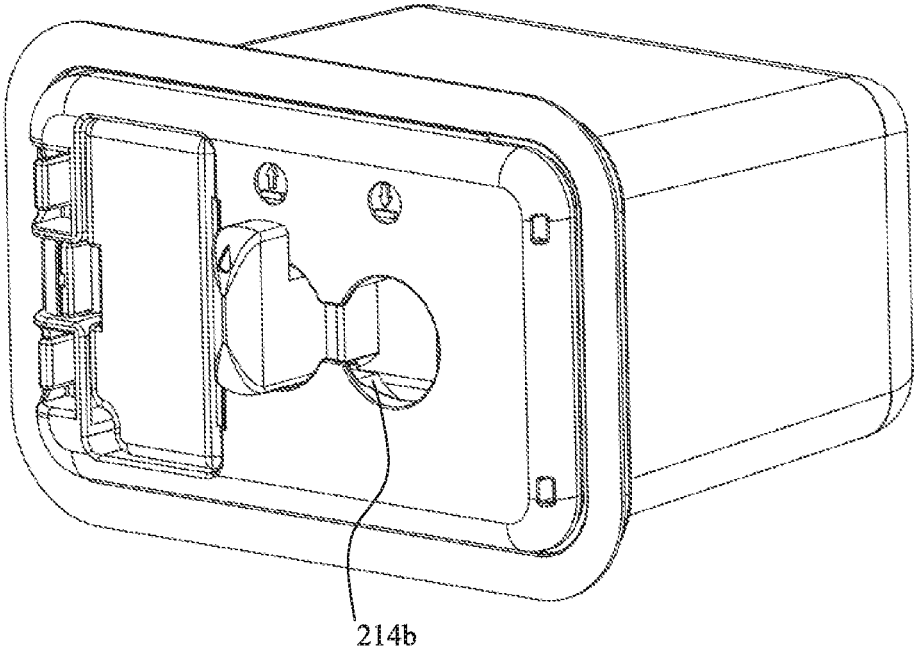
FIG. 10*a* is a perspective top view of the connected air pump in an inflation position.
Figure 10B:
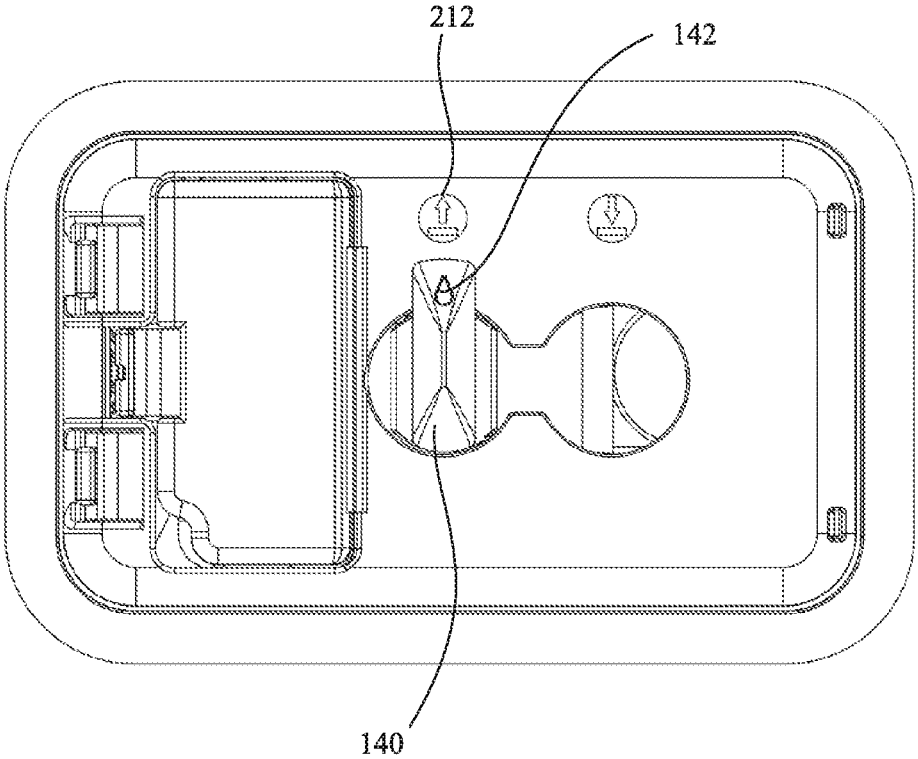
FIG. 10*b* is a top planar view of the connected air pump in the inflation position.
Figure 10C:
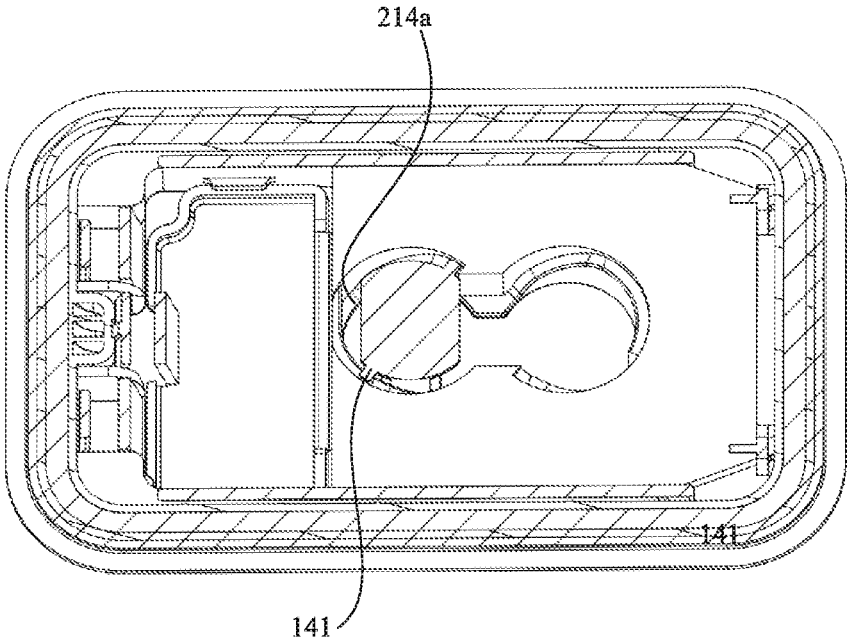
FIG. 10*c* is a cross-sectional view of the connected air pump taken from the inside of the upper cover.
Figure 10D:
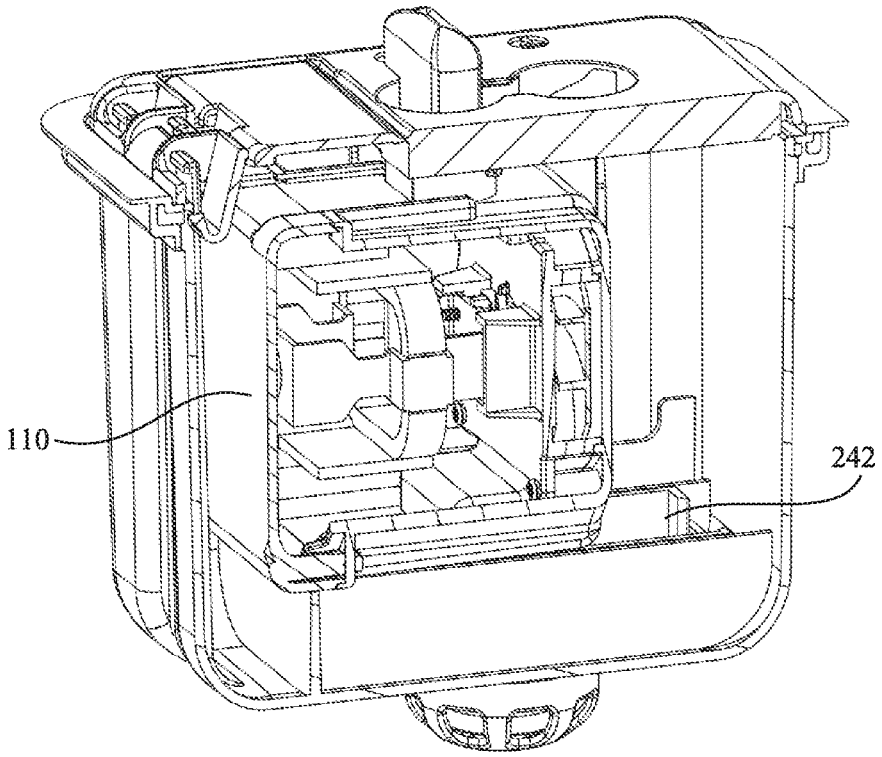
FIG. 10*d* is a cross-sectional perspective side view of the connected air pump.
Figure 10E:
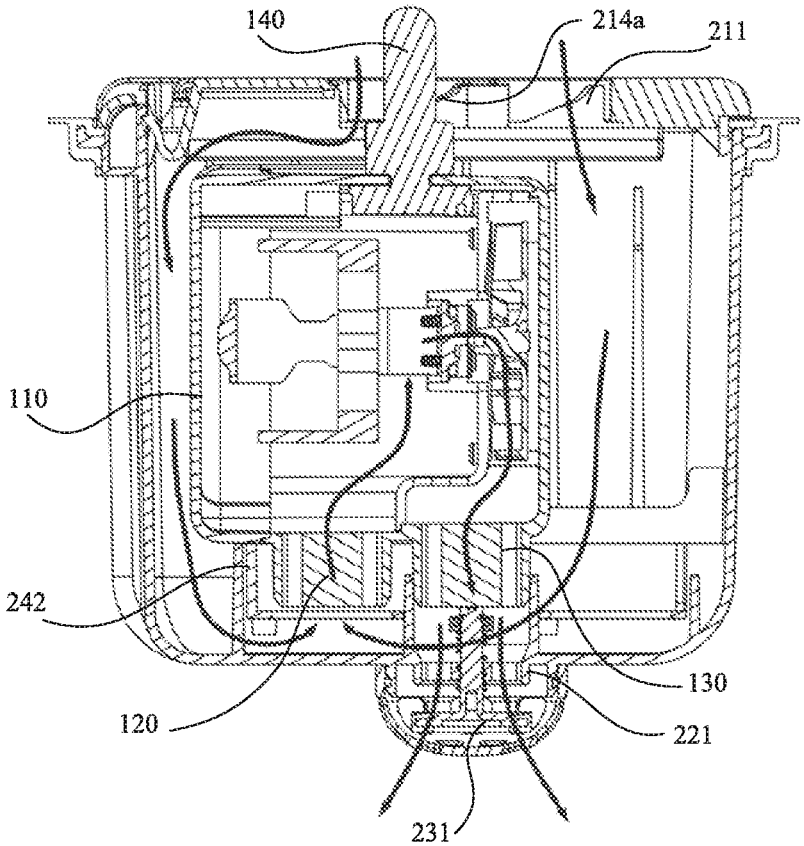
FIG. 10*e* is a cross-sectional side view illustrating the air flow path in the inflation position.
Figure 11A:
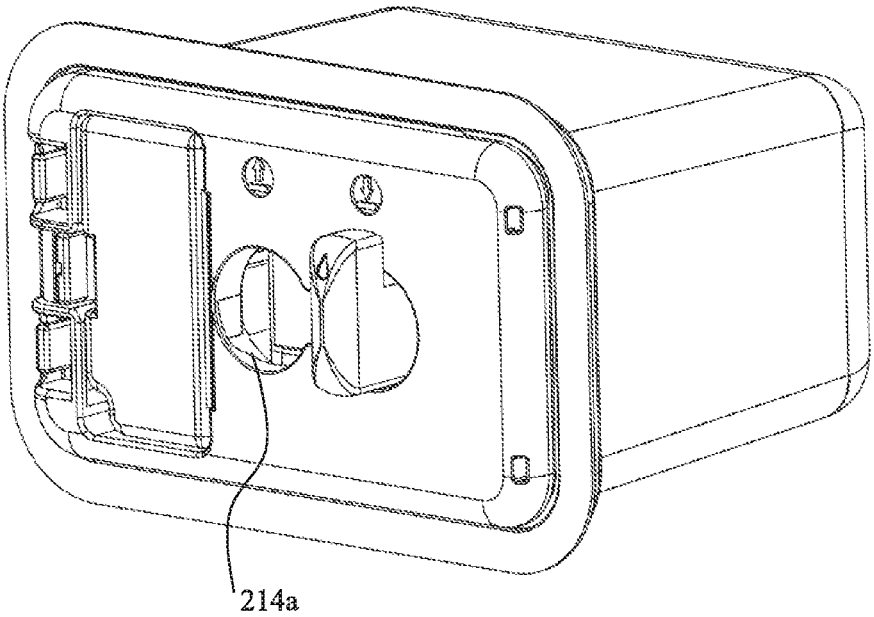
FIG. 11*a* is a perspective top view of the connected air pump in a deflation position.
Figure 11B:
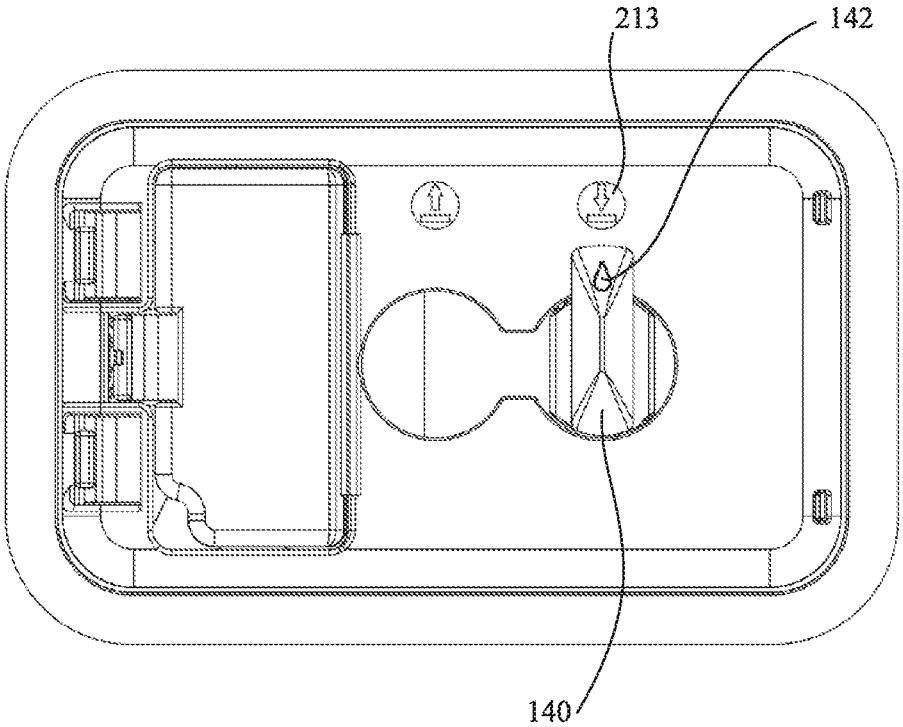
FIG. 11*b* is a top view of the connected air pump in the deflation position.
Figure 11C:
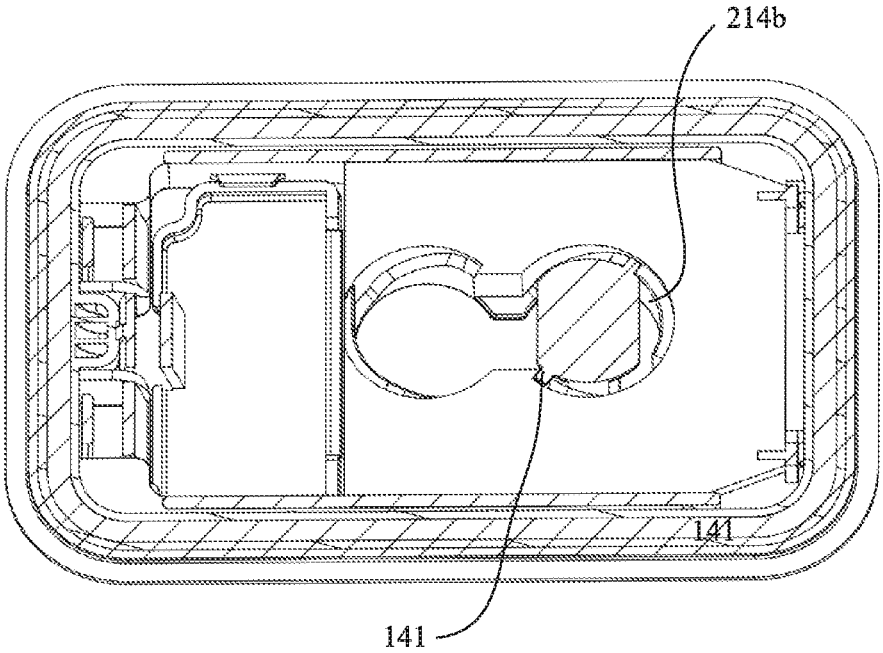
FIG. 11*c* is a cross-sectional view of the connected air pump taken from the inside of the upper cover.
Figure 11D:
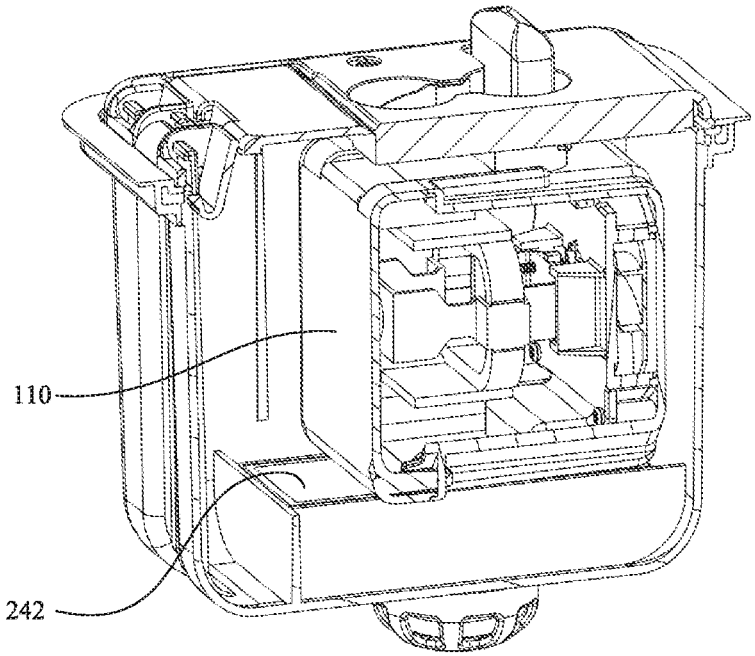
FIG. 11*d* is a cross-sectional perspective side view of the connected air pump.
Figure 11E:
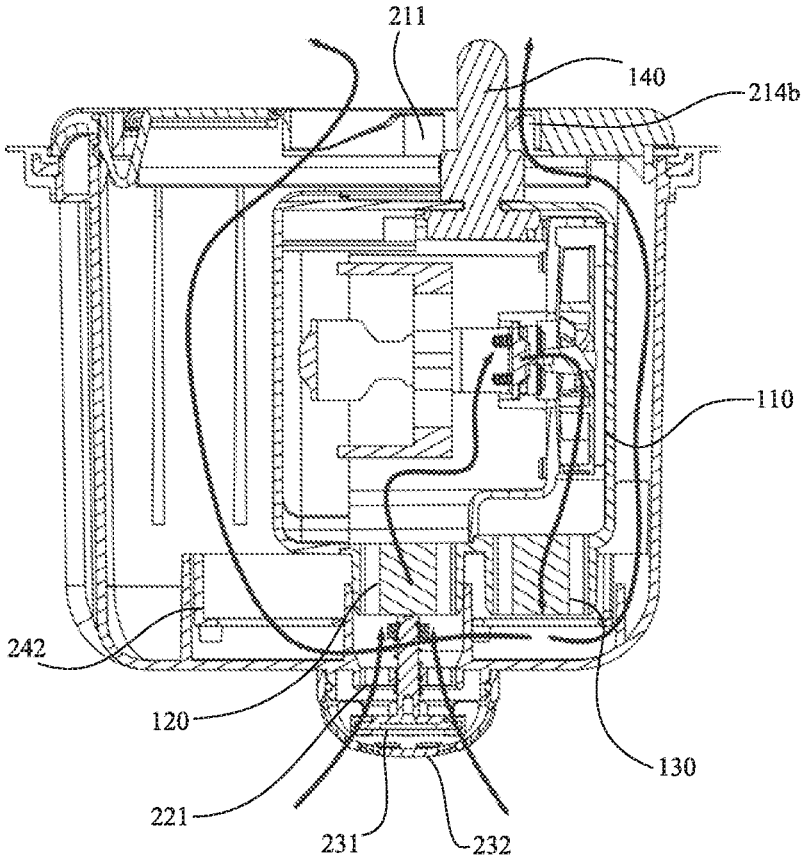
FIG. 11*e* is a cross-sectional side view illustrating the air flow path in the deflation position.

The support component 240 is illustrated in FIG. 7*a* and FIG. 7*b* in accordance with one embodiment of the subject invention. The support component 240 is provided with notches 243, 244, 245 corresponding to the air inlet 120 and the air outlet 130 of the air pump 100 and the vent hole 221 of the bottom portion 220. The first notch 243 of the support component 240 corresponds to the vent hole 221. When in the inflation state, the air inlet 120 of the air pump 100 is located in the second notch 244 of the support component 240, and the air outlet 130 is located in the first notch 243, as shown in FIG. 10*e*. When in the deflation state, the air outlet 130 of the air pump 100 is located in the third notch 245 of the support component 240, and the air inlet 120 of the air pump corresponds to the first notch 243 of the support component 240, as shown in FIG. 11*e*.

As described above, when the knob switch 140 starts the air pump 100, the pump body 110 is moved along the transverse direction towards the air valve 230 at the bottom of the shell 200, and presses the support component 240 to move towards the air valve 230. Additionally, when the knob switch 140 is reversely rotated and moved towards the outside of the internal chamber of the shell 200, the support component 240 can automatically reset to support the air pump 100, causing the air pump 100 to move away from the air valve 230. In some embodiments, the support component 240 may include a base 241. The base 241 is provided with a plurality of bosses 246 located on the bottom around the vent hole 230, and each of the bosses 246 is sleeved with an elastic member 250 to cause the base 241 to automatically reset. Optionally, components, such as elastic members 250 may be directly fixed to the bottom of the base 241 to assist in the reset function.

In some embodiments, the support component 240 may include a wall plate 242 that extends perpendicularly from a pair of opposing second edges of the base 241, and the pump body 110 of the air pump 100 can press the wall plate 242 of the support component 240 when the air pump 100 is moved along the transverse direction towards the air valve 230. Such an arrangement helps to assist in controlling the movement of the support component 240. Moreover, in some embodiments, the height of the wall plate 242 of the support component 240 may be greater than or equal to the length of the air inlet 120 and the length of the air outlet 130 that each protrude from the pump body 110. In other words, the wall plate 242 can abut against a bottom or a side of the pump body 110 according to different design requirements, so that the pump body 110 is reliably supported, and the internal structure of the shell 200 is more compact.

Figure 5A:
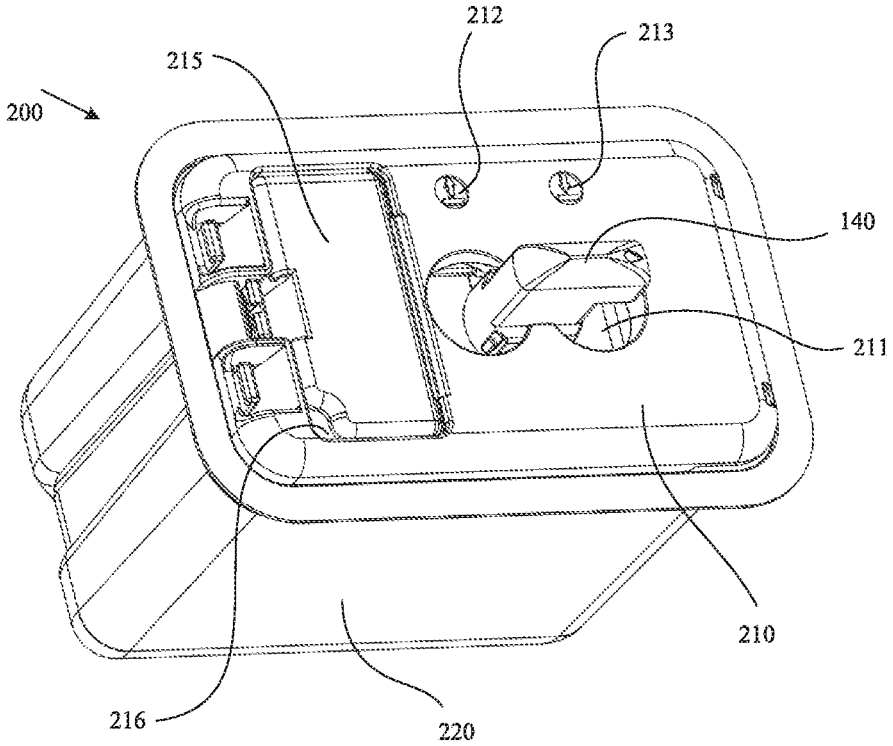
FIG. 5*a* is a perspective top view of the connected air pump according to an embodiment of the present invention wherein the air pump is located in a shell that is connected to the inflatable product (the inflatable product not being shown)
Figure 5B:
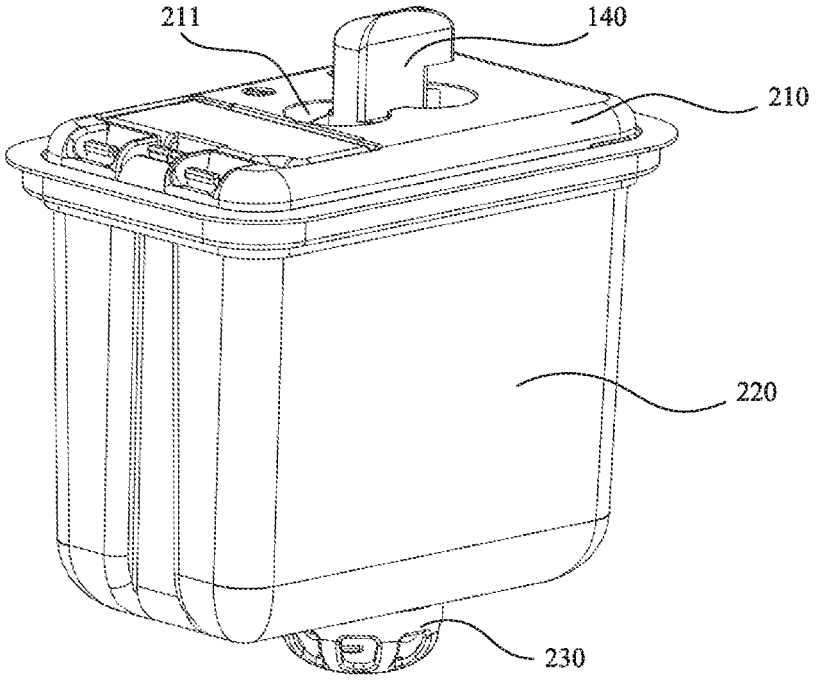
FIG. 5*b* is a perspective side view of the connected air pump illustrating an air valve on the shell.
Figure 6A:
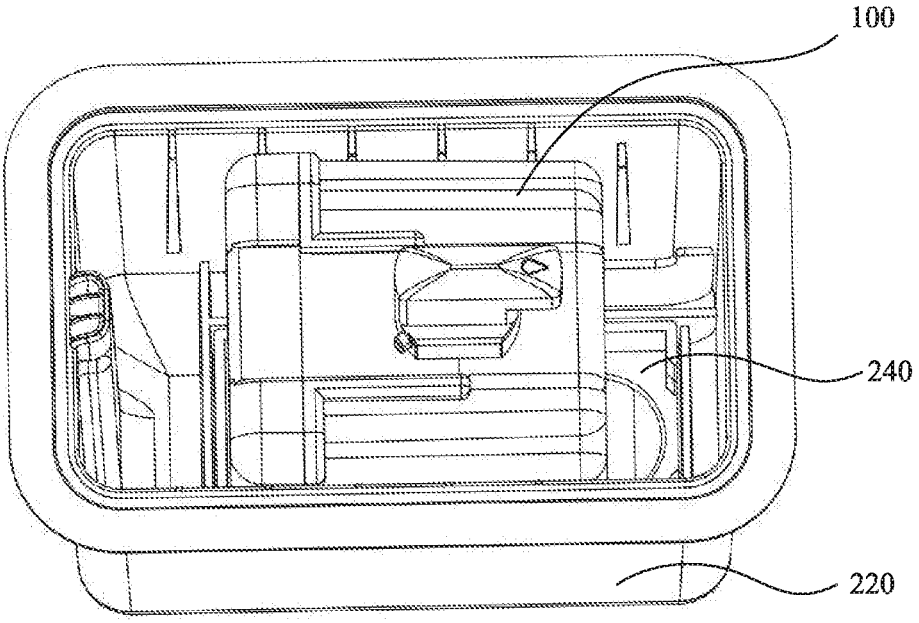
FIG. 6*a* is a perspective top view of the connected air pump with an upper cover of the shell removed.
Figure 6B:
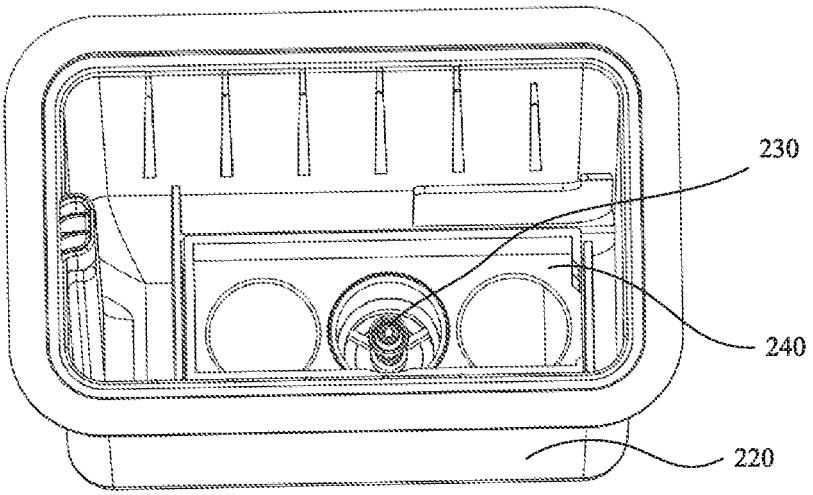
FIG. 6*b* is a perspective top view of the shell with the air pump and the upper cover of the shell removed.

In some embodiments, the shell 200 of the connected air pump 100 may be provided with a space for accommodating a power line, and the upper cover 210 may include an openable take-up cover 215, as shown in FIG. 5*a*. Optionally, the take-up cover 215 may also be provided with a notch 216, so that the take-up cover 215 can be closed after the power line is taken out or placed therein. Further, as described above, the air pump 100 can be used independently as a hand-held air pump 100, and therefore, the connector 150 of the inflatable product can also be accommodated in the space to facilitate the use of the air pump when it is removed from the shell 200.

The operation of the connected air pump 100 is further illustrated in FIG. 9*a* through FIG. 9*d* in a stop state/neutral position. As previously detailed, the opening 211 of the upper cover 210 may be bounded by three segments, including a first segment 211*a* having an arched portion corresponding to the inflation state or position, a second segment 211*b* having an arched portion corresponding to the deflation state or position, and a third segment 211*c* having a straight portion corresponding to the stop state or neutral position. In this embodiment, the third segment 211*c* may be located between the first segment 211*a* and the second segment 211*b*. The knob switch 140 is able to move between the first segment 211*a* and the second segment 211*b* along a path (arrow "A" in FIG. 8), and move while located at the first segment 211*a* or the second segment 211*b* along the transverse direction. However, in the third segment 211*c*, the knob switch 140 is unable to move along the transverse direction. When the knob switch 140 is moved from the third segment 211*c* to the first segment 211*a* along the path and then moved towards the internal chamber along the transverse direction, the knob switch 140 be rotated counterclockwise to start the air pump 100. The indicator 142 of the knob switch 140 can point to the inflation sign 212 provided on the upper cover 210, thereby indicating that the air pump 100 is in an inflation state or position. Conversely, when the knob switch 140 is moved from the third segment 211*c* to the second segment 211*b* along the path and then moved towards the inside of the internal chamber along the transverse direction, the knob switch 140 may be rotated counterclockwise to start the air pump 100. The indicator 142 of the knob switch 140 can point to the deflation sign 213 provided on the upper cover 210, thereby indicating that the air pump 100 is in a deflation state or position.

Figure 9B:
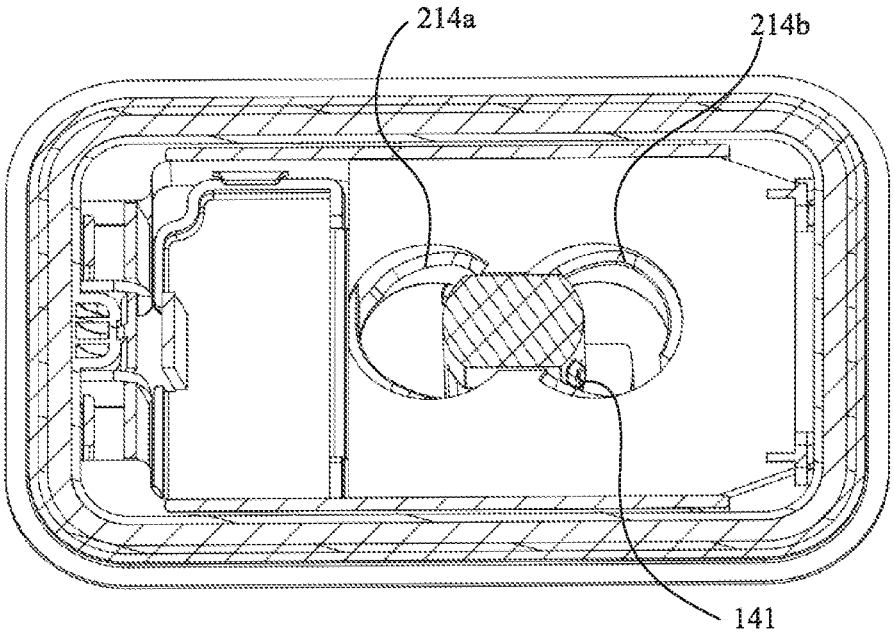
FIG. 9*b* is a cross-sectional top view of the connected air pump taken from the inside of the upper cover.

In this embodiment, the first segment 211*a* and the second segment 211*b* of the opening 211 are respectively provided with a vertical wall extending from an edge of the first and second segments 211*a* and 211*b* to the internal chamber of the shell 200. The limit structure comprises guide rails 214 disposed on the vertical walls, for example, a first guide rail 214*a* on the first segment 211*a* and a second guide rail 214*b* on the second segment 211*b*, as illustrated in FIG. 9*b*. Correspondingly, the knob switch 140 of the air pump 100 is provided with protruding blocks 141 cooperating with the guide rails 211 or in an alternative embodiment (not shown) sliding grooves cooperating with flanges. As illustrated, the protruding blocks 141 may be symmetrically disposed on two sides of the knob switch 140. Advantageously, the guide rails 214*a*, 214*b* each extend obliquely from a starting end to a terminating end and towards the inside of the shell 200. As such, when the knob switch 140 is rotated, the protruding blocks 141 of the knob switch 140 gradually move obliquely towards the inside of the shell 200 along the first guide rail 214*a* and/or the second guide rail 214*b*, thereby driving the pump body 110 downward within the shell 200. The downward movement of the pump body 110 is along the transverse direction B (as shown in FIG. 8), thus causing the air inlet 120 or the air outlet 130 to be aligned with the air valve 230 of the shell 200 to prevent unintended use or operation, as described above.

Figure 9C:
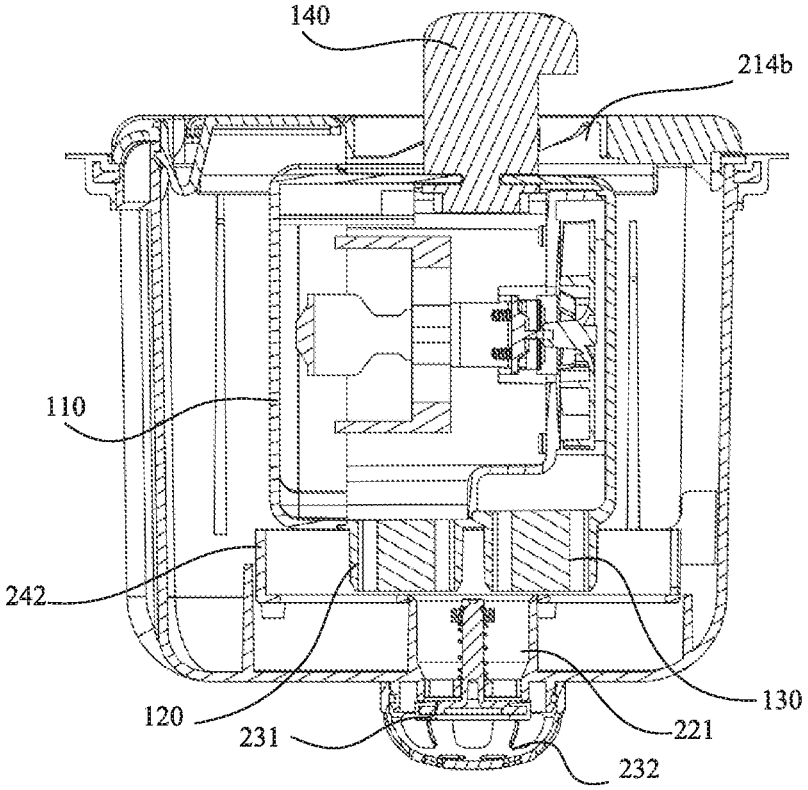
FIG. 9*c* is a cross-sectional side view of the connected air pump.
Figure 9D:
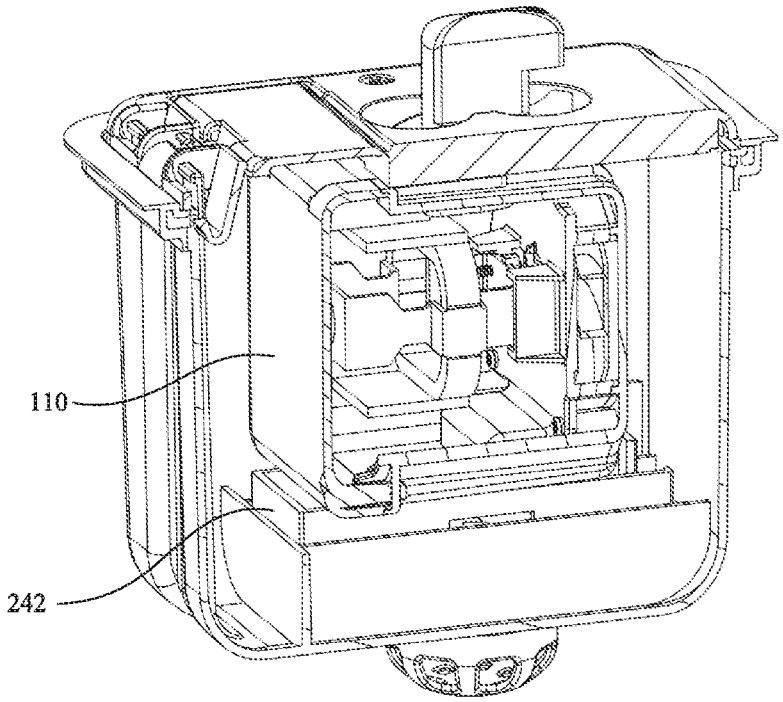
FIG. 9*d* is a cross-sectional perspective side view of the connected air pump.

As illustrated in the embodiment of FIG. 9*c* and FIG. 9*d*, in the stop state or neutral position, the pump body 110 may be substantially within the center of the shell 200, with the air inlet 120 and the air outlet 130 of the air pump 100 not aligned or in communication with the air valve 230, and with the valve plug 231 at the vent hole 221 closing the vent hole 221 to prevent air leakage. It should be appreciated however, that the neutral position can refer to other positions that are not the inflation position or deflation position.

When the knob switch 140 is moved from the third segment 211*c* to the first segment 211*a* and rotated counterclockwise, the protruding blocks 141 of the knob switch 140 are moved obliquely along the first guide rail 214*a*, pushing the connected air pump 100 to the inflation state or position, as shown in FIG. 10*a* to FIG. 10*e*. As such, the indicator 142 of the knob switch 140 points to the inflation sign 212, as viewed from the outside of the shell 200. As shown in FIG. 10*e*, in this state, the pump body 110 presses downwardly against the vertical walls 242 of the support component 240, and the air outlet 130 of the air pump 120 is aligned with the air valve 230 and pushes the valve plug 231 to move down to open the vent hole 221. Thus, as indicated by the airflow arrows in FIG. 10*e*, an inflation path is formed using the connected air pump 100. More particularly, air flow enters the shell 200 from the opening 211 of the upper cover 210, then enters the air inlet cavity of the pump body 110 from the air inlet 120 of the air pump 110, thereafter flowing into the air outlet cavity, and then entering the inflatable product via the air outlet 130 and the vent hole 221 in communication therewith to effect inflation.

As shown in FIG. 11*a* to FIG. 11*e*, when the knob switch 140 is moved along the third segment 211*c* to the second segment 211*b* and rotated counterclockwise, the protruding blocks 141 of the knob switch 140 are moved obliquely along the second guide rail 214*b*, and the connected air pump 100 is moved into the deflation state. At this time, the indicator 142 of the knob switch 140 points to the deflation sign 213, as viewed from the outside of the shell 200. As shown in FIG. 11*e*, in this state, the pump body 110 presses the vertical walls 242 of the support component 240 down, and the air inlet 120 of the air pump 100 is aligned with the air valve 230 and pushes the valve plug 231 to move down to open the vent hole 221. Thus, as indicated by the airflow arrows in FIG. 11*e*, a deflation path is formed in the connected air pump 100. More particularly, the air flow enters the shell 200 from the inflatable product via the vent hole 221, then enters the air inlet cavity of the pump body 110 along the air inlet 120 of the air pump 100, thereafter flowing into the air outlet cavity, and then flowing out of the shell 200 from the opening 211 of the upper cover via the air outlet 130 to effect deflation.

FIG. 12*a* through FIG. 14*b* show a connected air pump 100 according to a second embodiment of the present invention, which differs from the above embodiment in the arrangement of the opening 411 of the shell 200 and the knob switch 340 of the air pump. With initial reference to FIG. 12*a* and FIG. 12*b*, the stop state or neutral position of the connected air pump 100 is shown. In this embodiment, the first segment 411*a* and the second segment 411*b* of the opening 411 of the upper cover 410 also have arched segments for rotation of the knob switch 340, and the third segment 411*c* is disposed on one side of the first segment 411*a* or the second segment 411*b*. The first segment 411*a* may correspond to the first position, and the second segment 411*b* may correspond to the second position. As such, when the knob switch 340 is located in a portion of the opening bounded by the first segment 411*a* and moved along the transverse direction, it is moved into the first position. When the knob switch 340 is located in a portion of the opening bounded by the second segment 411*b* and moved along the transverse direction, it is moved into the second position. It should be appreciated that the first segment 411*a* could alternatively correspond to the second position and the second segment 411*b* could alternatively correspond to the first position depending on the location of the air inlet 120 and air outlet 130.

Figure 12A:
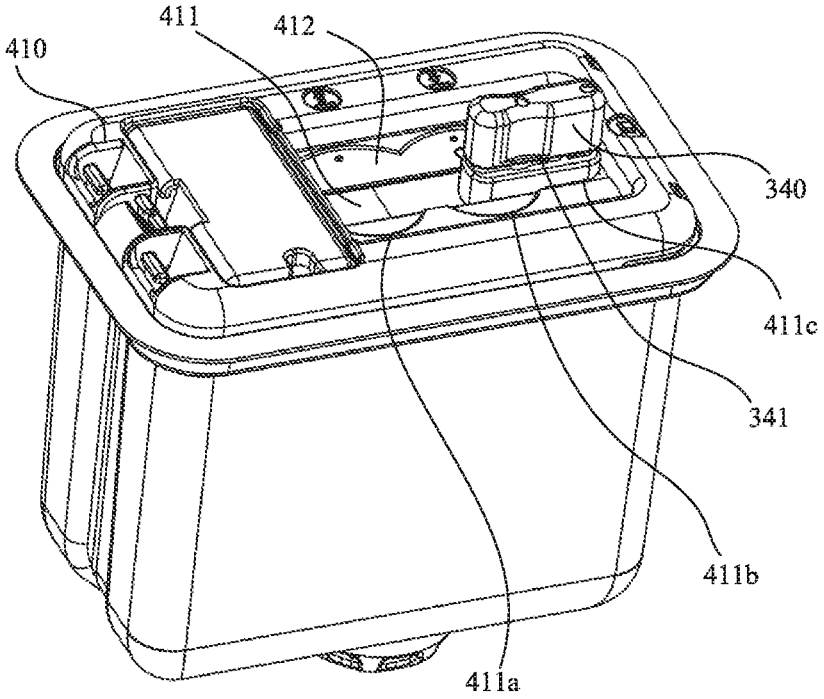
FIG. 12*a* is a perspective top view of the connected air pump in a neutral position according to another embodiment of the present invention.
Figure 12B:
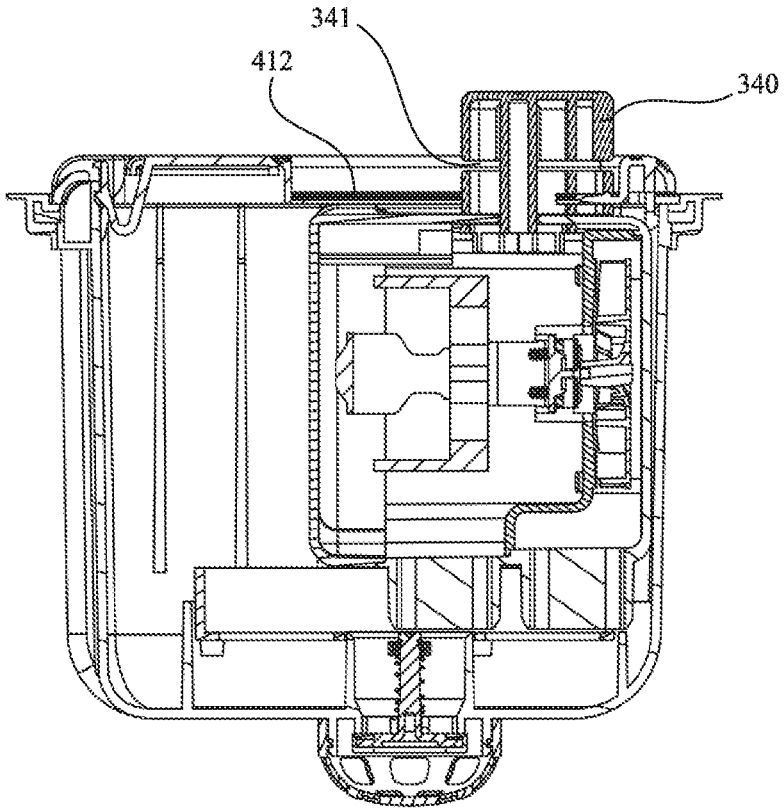
FIG. 12*b* is a cross-sectional side view of the connected air pump in the neutral position.

In this embodiment, the limit structure comprises limit plates 412 respectively extending from the edges of the first segment 411*a* and the second segment 411*b* along a path. The knob switch 340 of the air pump 100 is provided with clamping grooves 341. After the knob switch 340 is moved along the path to the first segment 411*a* or the second segment 411*b*, the knob switch 340 may be pressed to move along the transverse direction towards the internal chamber of the shell 200 and rotated. As the knob switch 340 is pressed, the clamping grooves 341 cooperate with the limit plates 412 to fix the knob switch 340 into its desired rotation and transverse position. More particularly, in the third segment 411*c*, the air pump 100 is at an edge of the shell 200, and thus, neither the air inlet 120, nor the air outlet 130 of the air pump 100 is aligned or in communication with the air valve 230, as shown in FIG. 12*b*, and at this time, the valve plug 231 at the vent hole blocks the vent hole 232.

Figure 13A:
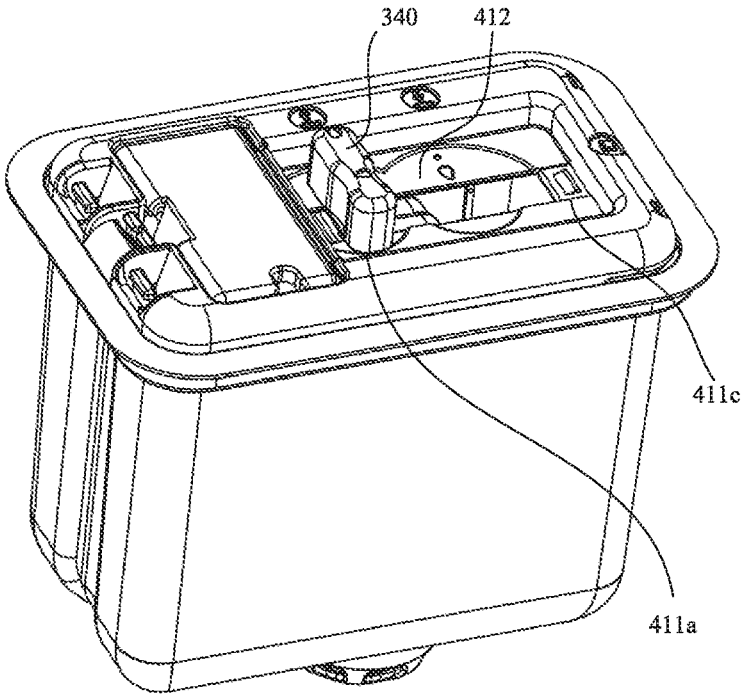
FIG. 13*a* is a perspective top view of the connected air pump in the inflation position.
Figure 13B:
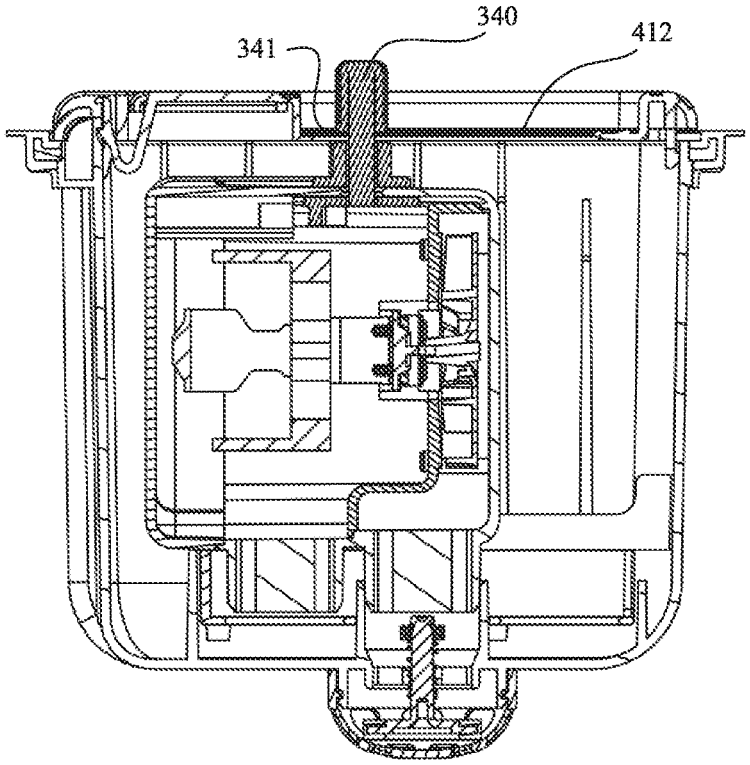
FIG. 13*b* is a cross-sectional side view of the connected air pump in the inflation position.
Figure 14A:
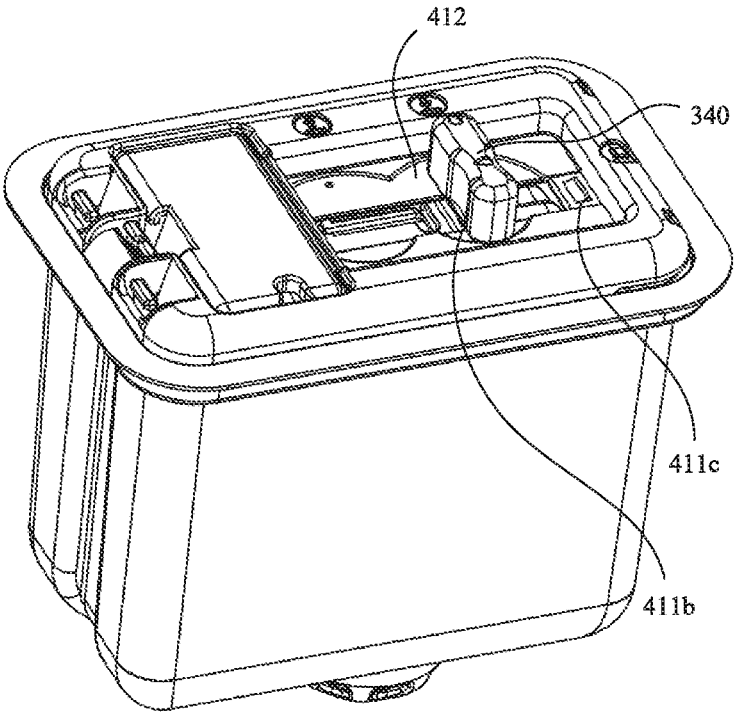
FIG. 14*a* is a perspective top view of the connected air pump in the deflation position.
Figure 14B:
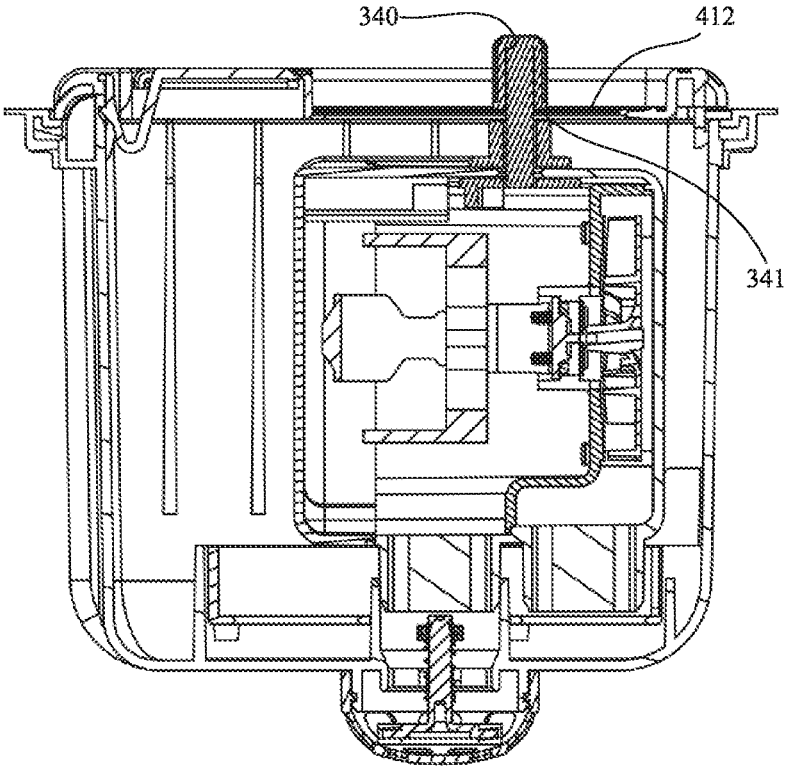
FIG. 14*b* is a cross-sectional side view of the connected air pump in the deflation position.

When the knob switch 340 is translated from the third segment 411*c* to the first segment 411*a* along the path and then moved towards the internal chamber along the transverse direction, the knob switch 340 is rotated counterclockwise, and the clamping grooves 341 of the knob switch 340 are engaged with the limit plates 412. As such, the connected air pump 100 is moved into the inflation state, as shown in FIG. 13*a* and FIG. 13*b*. Similarly, when the knob switch 340 is translated from the third segment 411*c* to the second segment 411*b* along the path and then moved towards the internal chamber along the transverse direction, the knob switch 340 is rotated counterclockwise, and the clamping grooves 341 of the knob switch 340 are engaged with the limit plates 412. As such, the connected air pump 100 is moved into a deflation state, as shown in FIG. 14*a* and FIG. 14*b*.

Figure 15A:
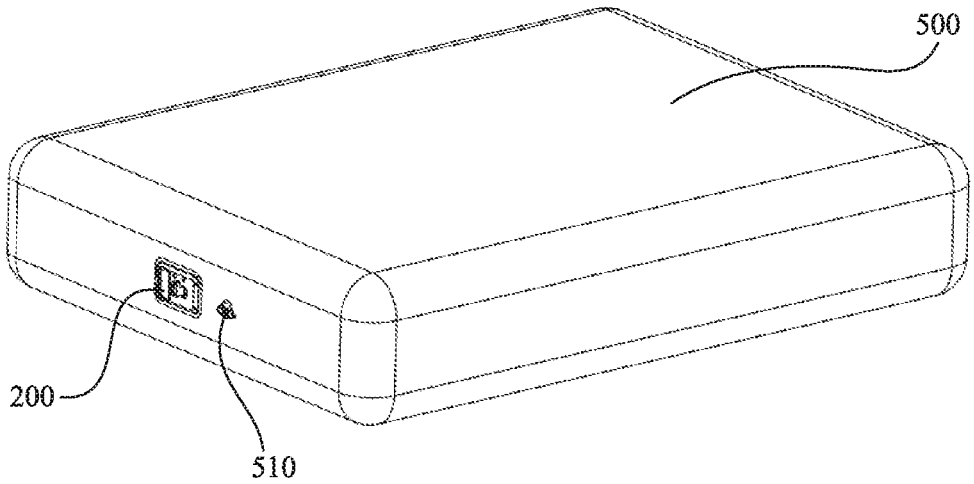
FIG. 15*a* is a perspective top view of the connected air pump located in a provided inflatable product.
Figure 15B:
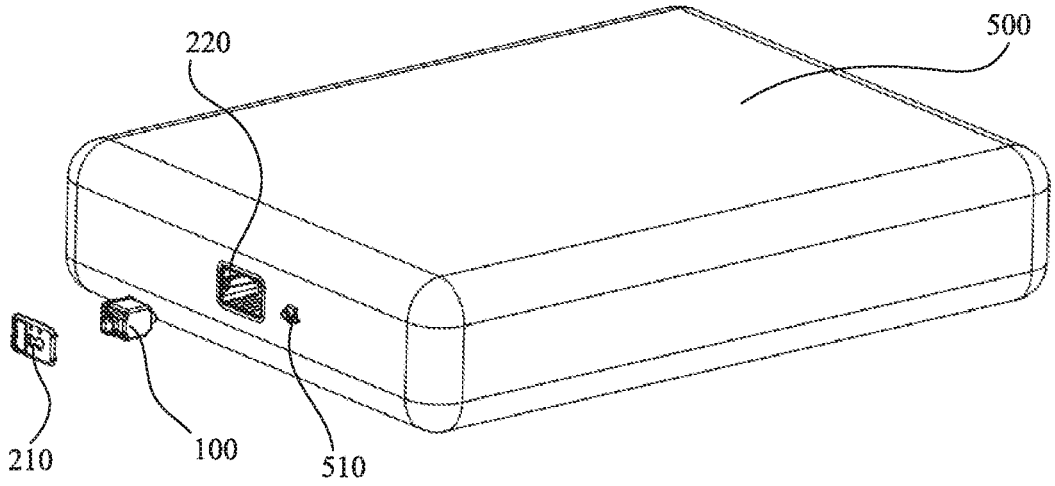
FIG. 15*b* is an exploded view of the connected air pump for use with the provided inflatable product.

FIG. 15*a* and FIG. 15*b* show an embodiment of the present invention applying the connected air pump 100 to an inflatable product, such as a mattress 500. As shown in FIG. 15*b*, the air pump 100 can be taken out by removing the upper cover 210 of the shell 200 from the bottom portion 220, so that the air pump 100 can be used independently from the shell 200 to inflate and deflate other inflatable products, and later reintroduced into the shell 200. After the air pump 100 is removed from the shell 200, the mattress 500 may be separately inflated and deflated through the air valve 510. Therefore, the present invention provides flexible and variable use whether the air pump 100 is used alone or in combination with the shell 200 as a connected air pump.

Figure 16A:
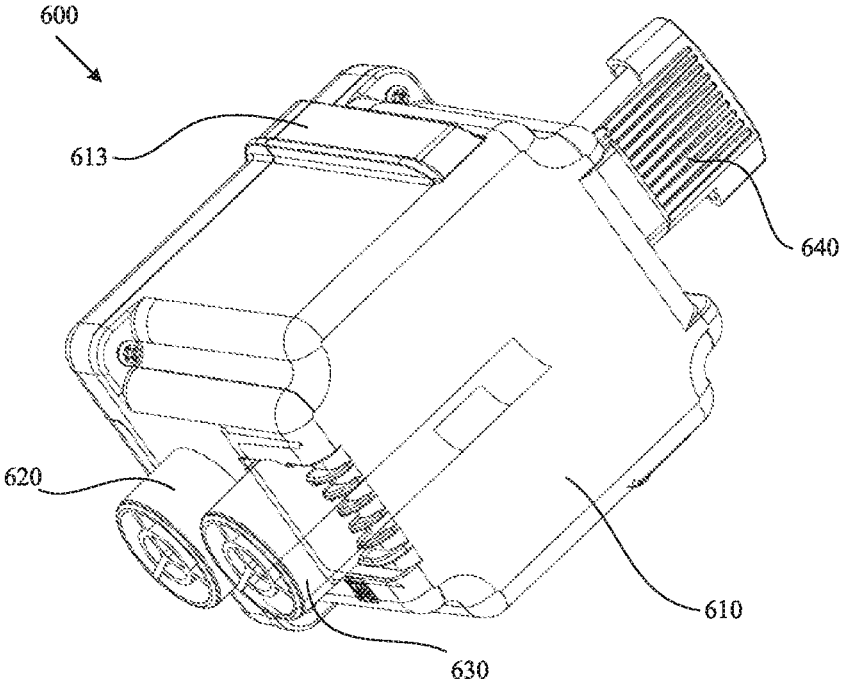
FIG. 16*a* is a bottom perspective view of the air pump according to yet another embodiment of the present invention.
Figure 16B:
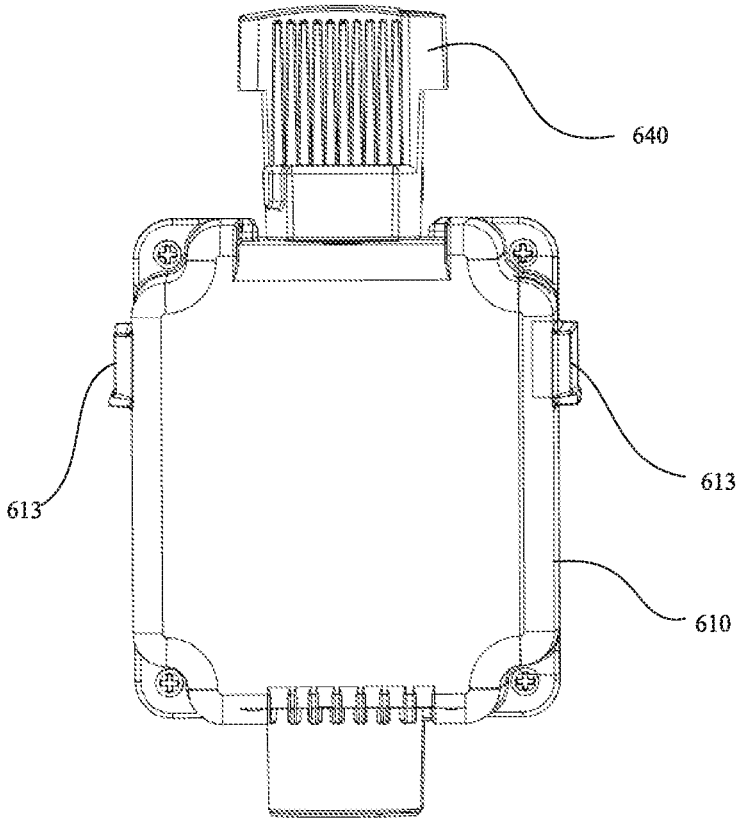
FIG. 16*b* is a side view of the air pump illustrated in FIG. 16*a;*

FIG. 16*a* and FIG. 16*b* show an air pump 600 for an inflatable product according to another embodiment of the present invention. The air pump 600 includes a pump body 610, an air inlet 620 and an air outlet 630. A drive assembly is arranged in the pump body 610, and a knob switch 640 extends outside of the pump body 610. For the sake of simplicity, the structures and operations similar to those of the above embodiments will not be repeated in detail.

Figure 17A:
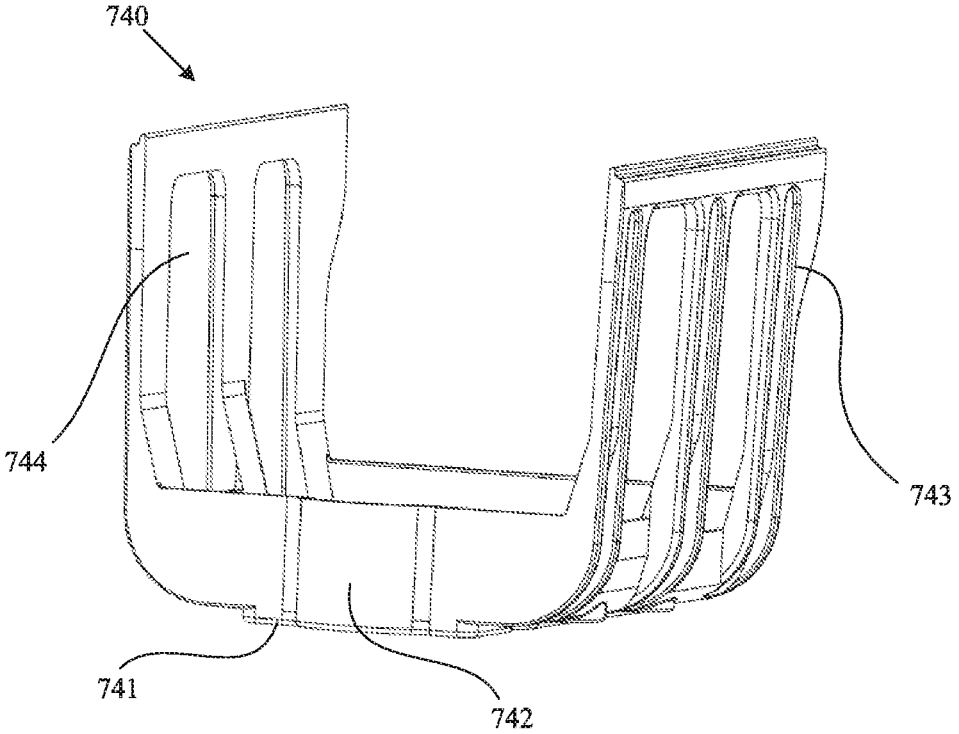
FIG. 17*a* is a perspective view of the support component according to another embodiment of the subject invention.
Figure 17B:
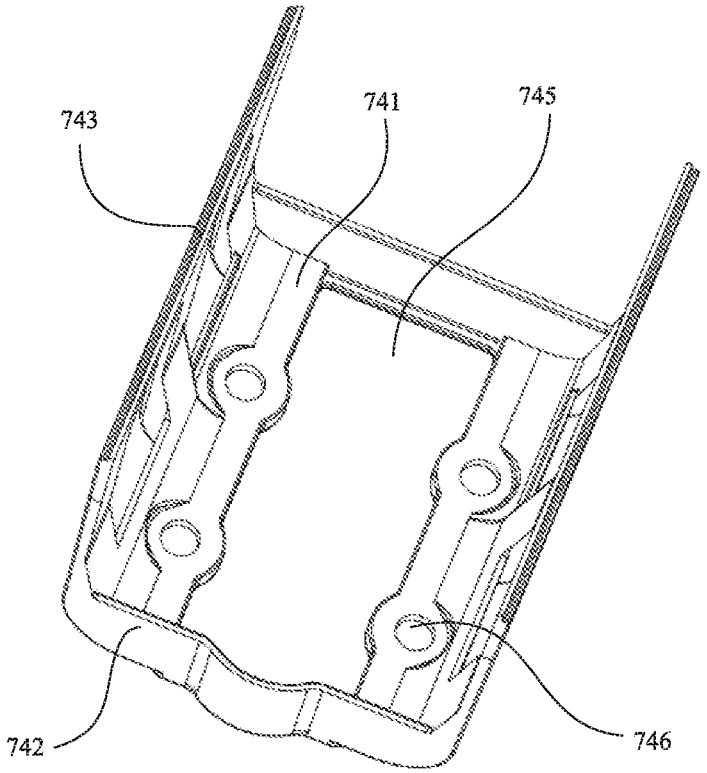
FIG. 17*b* is a top perspective view of the support component illustrated in FIG. 17*a;*
Figure 19:
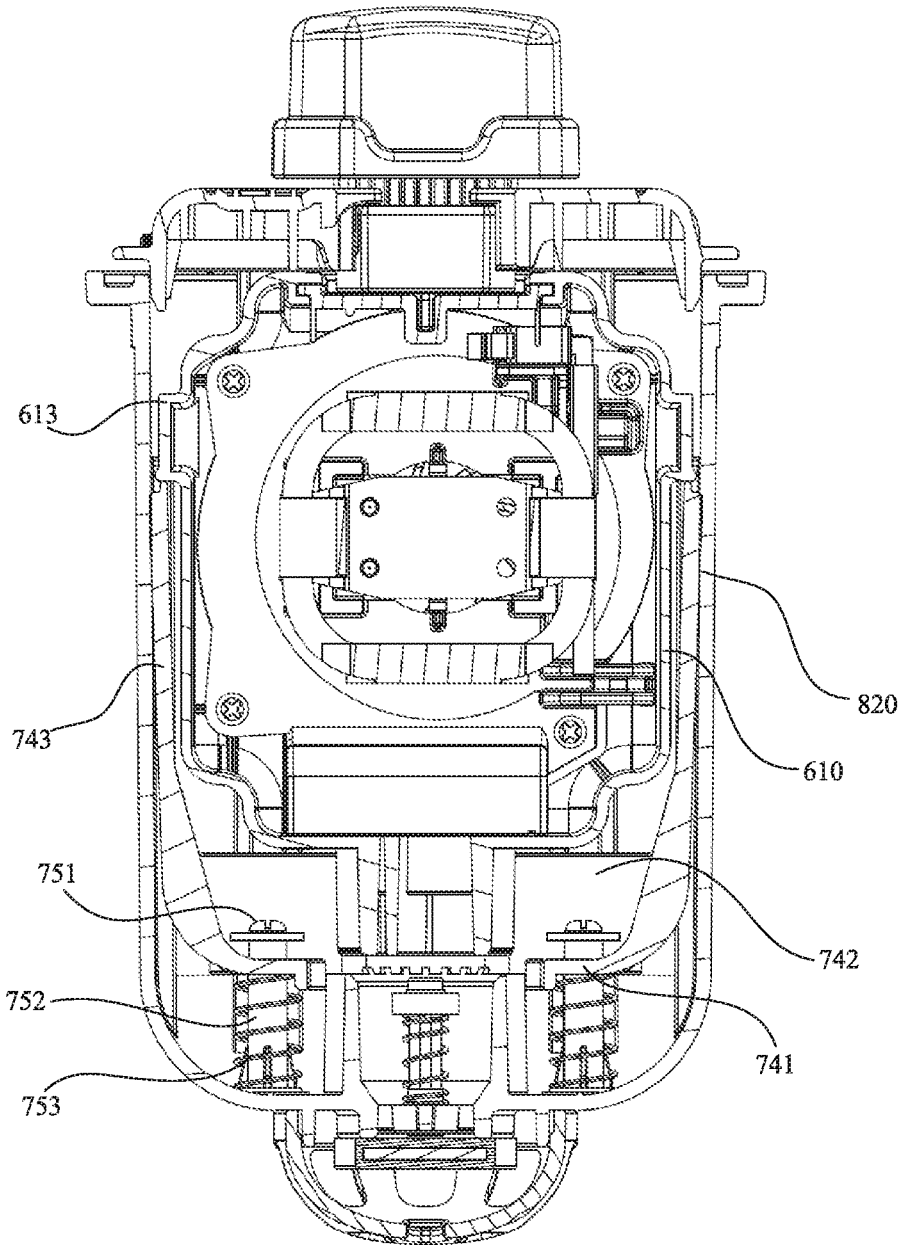
FIG. 19 is another cross-sectional view of the support component located in the shell and supporting the air pump.

With reference to FIG. 16*a* and FIG. 16*b*, a portion of the outer side wall of the pump body 610 may be enclosed by the support component 740 and provided with an abutting part cooperating with the support component 740. For example, the abutting part may be shaped as a pair of convex strips 613 protruding from the outer side wall of the pump body 610 and arranged on opposing sides. The pair of convex strips 613 may advantageously extend along a direction parallel to a side wall of the inflatable product. Accordingly, as shown in FIG. 17*a* and FIG. 17*b*, the support component 740 may comprise a base 741, and the base 741 may include a notch 745 having a location corresponding to the air valve 230 of the shell for aligning the air inlet 620 and/or the air outlet 630 of the air pump 600 with the air valve 230 of the shell. One side of an edge of the base 741 that faces the pump body 610 is provided with a pair of support plates 743 which extend perpendicularly and are oppositely arranged on a pair of first opposing edges of the base 741 The pair of support plates 743 may respectively extend to enclose most of the outer side wall of the pump body 610 and can abut against the pair of convex strips 613 of the pump body 610. In this way, as shown in FIG. 19, when the pump body 610 translates towards the air valve 230 along the transverse direction, the convex strip 613 on the pump body 610 can press the support plate 743 of the support component 740 to move towards the air valve 230. Otherwise, when the pump body 610 translates away from the air valve 230 along the transverse direction, the support component 740 can be reset and the pump body 610 be caused to move away from the air valve 230 by the abutting action of the support plate 743 and the convex strip 613. At the same time, since the support component 740 encloses part of the pump body 610, more stable support can be provided to the pump body 610. Correspondingly, because the convex strips 613 extends along a direction parallel to the side wall, they abut against a free end of the support plate 743 to further provide a support function to smooth movement of the pump body 610 when the air pump 600 translates along the path such that the position of the air inlet 620 or the air outlet 630 matches (or at least partially overlaps) the position of the air valve 230 and connects thereto.

In some embodiments, such as shown in FIG. 17*a*, the support plate 743 may be provided with a grid 744. The grid 744 may extend parallel or perpendicular to a side wall of the inflatable product. As a result, the material requirements and weight of the support component 740 can be reduced with an improvement in heat dissipation. As such, during the operation, the pump body 610 does not over heat as a result of being enclosed.

In some embodiments, similar to the support component 240 described above, the support component 740 may further include a pair of wall plates 742 extending perpendicularly from the edge of the base 741 towards the pump body and arranged oppositely. Advantageously, the pair of wall plates 742 are arranged alternately with the pair of support plates 743, as shown in FIG. 17*b*. The length of the wall plates 742 may be greater than or equal to the length of the part of the pump body 610 that surrounds the air inlet 620 and the air outlet 630 and protrude outwardly along the transverse direction. As shown in FIG. 19, the wall plates 742 can abut against the bottom or side of the pump body 610. In an optional embodiment, when the position of the air inlet 620 or the air outlet 630 of the air pump 600 matches the position of the air valve 230 of the shell 820, one of the pair of wall plates 742 may abut against a bottom wall of the pump body 610 that faces the air valve 230, thereby ensuring reliable support for the pump body 610 and making the internal structure of the shell 820 more compact.

Figure 18:
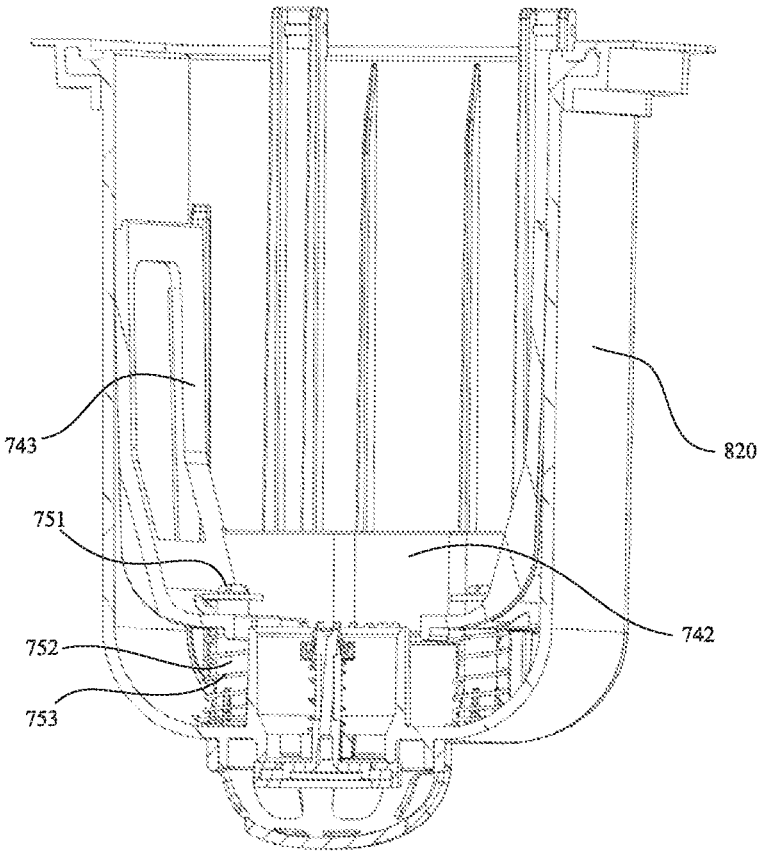
FIG. 18 is a cross-sectional view of the support component located in the shell.

In order to reset the support component 740 and facilitate the pump body 610 moving away from the air valve 230 along the transverse direction, a plurality of fixing holes 746 are provided in the base 741 of the support component 740, as shown in FIG. 17*b*. Accordingly, as shown in FIG. 18 and FIG. 19, a plurality of bosses 752 may be provided in the internal chamber of the shell 820. Each boss 752 is sleeved with an elastic member 753 and is mated with a fixing hole 746 of the support component 740. Optionally, the bosses 752 may be provided with a thread so as to fixedly connect the bosses 752 by passing, for example, a threaded fastener 751 through the fixing hole 746, thereby realizing an automatic reset function by the directional bias of the elastic member 753. It should be understood that in an optional embodiment, similar bosses may also be provided at the bottom of the base 741 of the support component 740 facing the air valve 230 of the shell 820, as in the support component 240 described above.

FIG. 20*a* to FIG. 20*f* show another embodiment of an air pump 1000 for an inflatable product. Similar to the above embodiments, the air pump 1000 comprises a pump body 1100. The pump body 1100 may comprise a first pump body 1110 and a second pump body 1120 (FIG. 20*f*) connected to each other. A driving assembly is located inside the pump body 1100 and comprises an impeller 1600, a driving motor 1700, and a pump cover 1800. The pump cover 1800 fixes and separates the impeller 1600 and the driving motor 1700. A knob switch 1400 extends outside of the pump body 1100. The knob switch 1400 may be provided with an indicator 1420 for indicating the state or position of the air pump 1000, and a protruding block 1410 cooperating with the opening 2110 of the shell 2000 when the air pump 1000 is used as a connected air pump. When the knob switch 1400 is rotated, the trigger switch 1900 in the pump body 1100 can be engaged/disengaged to turn on/off a start-up circuit of the driving motor 1700, thereby switching on/off the air pump 1000. In the start state, air can flow from the air inlet 1200 to the air outlet 1300 via the pump cover 1800 and the impeller 1600 along the arrow in FIG. 20*e*.

Figure 20A:
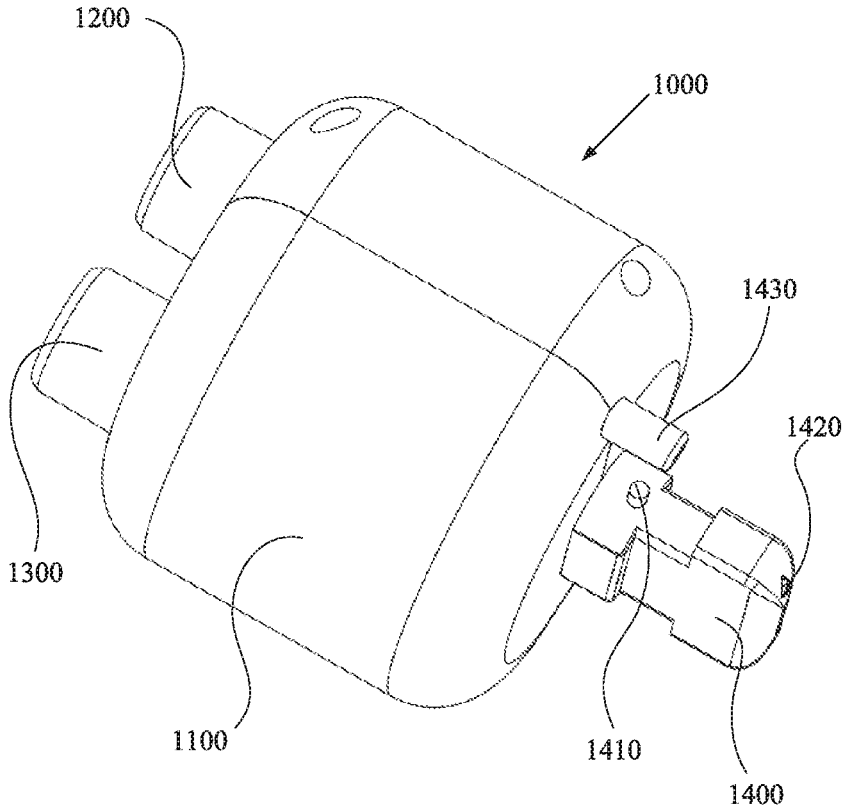
FIG. 20*a* is a perspective side view of the air pump for an inflatable product according to another embodiment of the present invention.
Figure 20B:
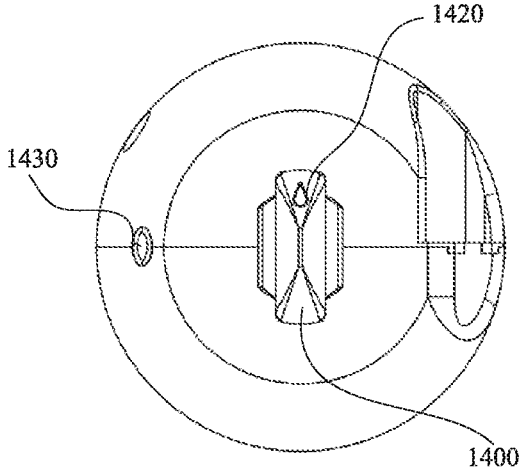
FIG. 20*b* is a top view of the air pump in the neutral position.
Figure 20C:
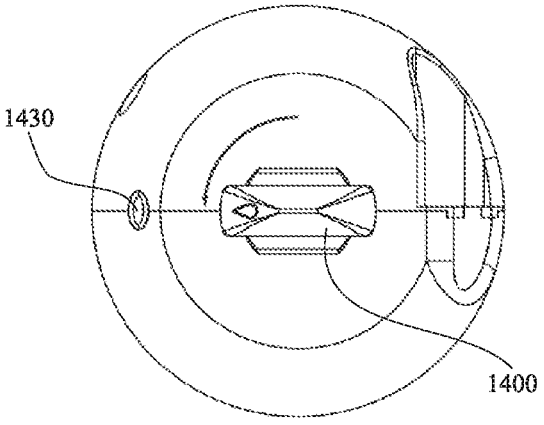
FIG. 20*c* is another top view of the air pump in the inflation position.
Figure 20D:
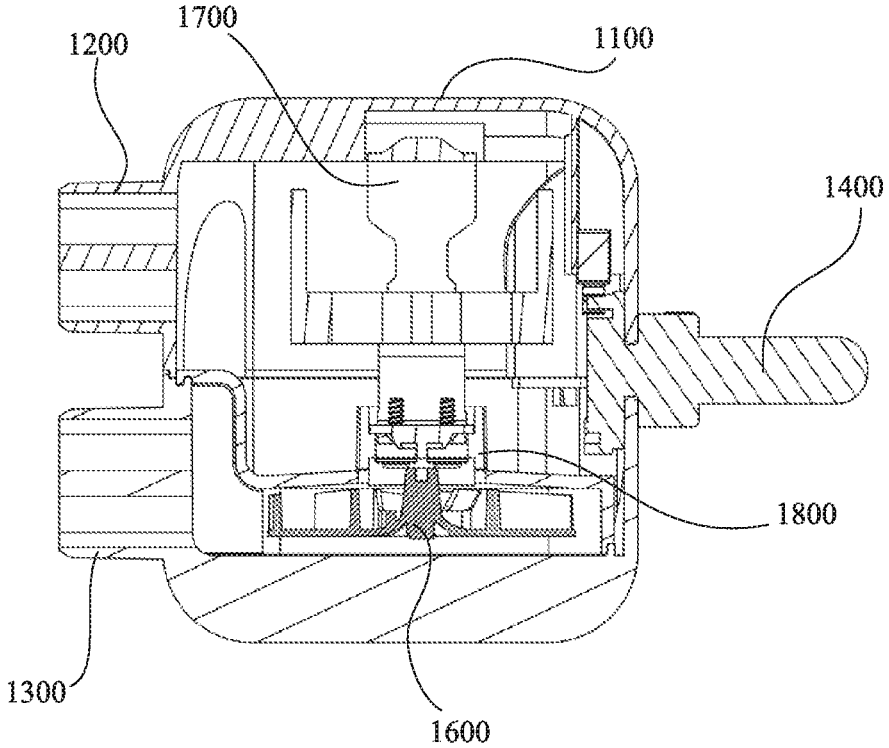
FIG. 20*d* is a cross-sectional side view of the air pump in the inflation position.
Figure 20E:
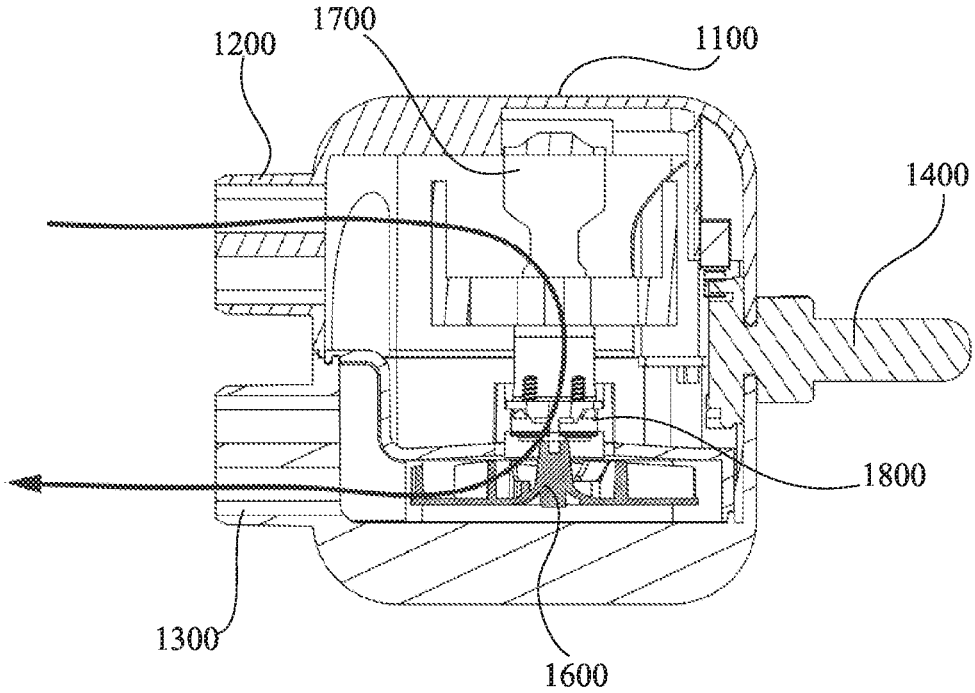
FIG. 20*e* is another cross-sectional side view of the air pump illustrating the air flow path in the inflation position.
Figure 20F:
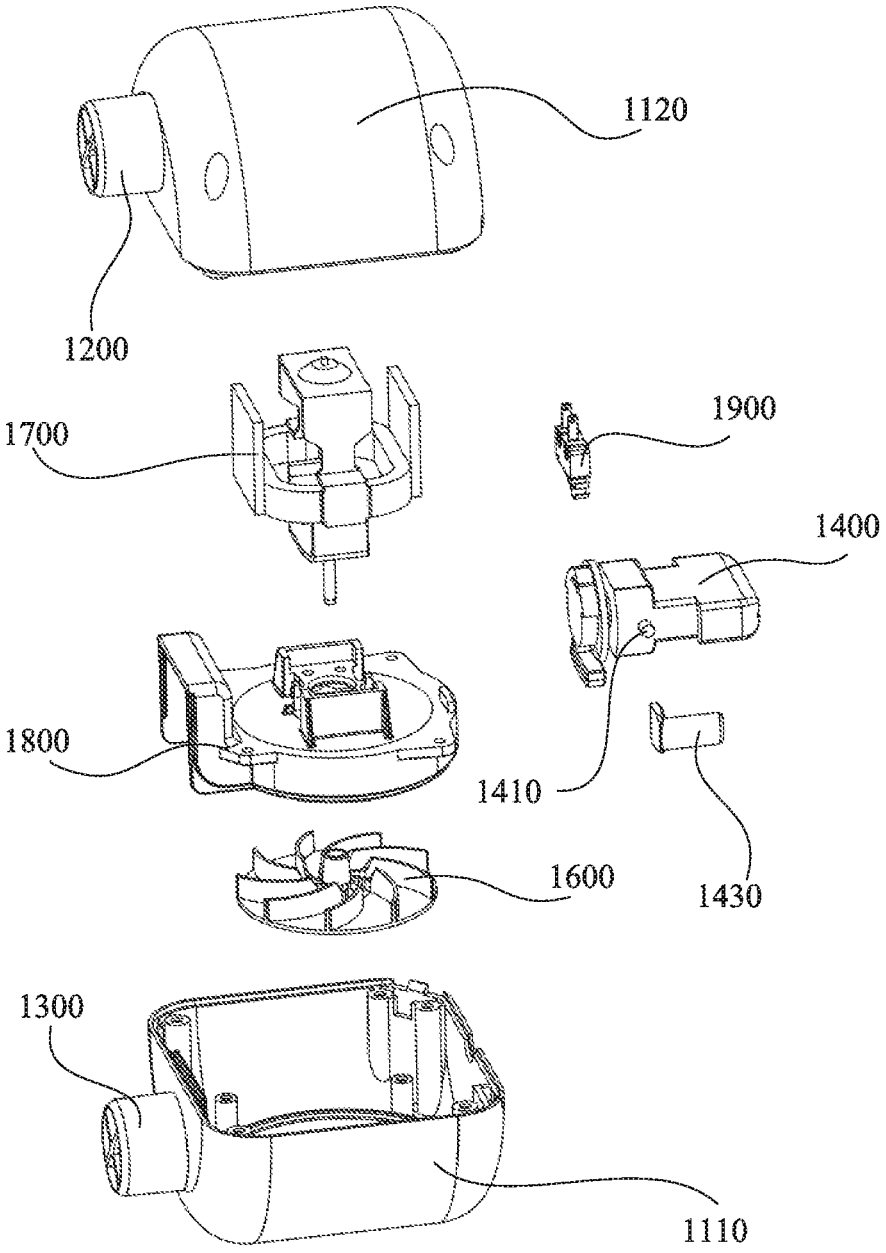
FIG. 20*f* is an exploded perspective side view of the air pump.

In this embodiment, an air outlet 1300 may be provided on the first pump body 1110, an air inlet 1200 may be provided on the second pump body 1120, and a switching lever 1430 may be disposed on the same plane of the knob switch 1400, as shown in FIG. 20*a*. When the air pump 1000 is used as a connected air pump, the air pump 1000 can be switched between a first position, a second position, and any intermediate or neutral positions by means of the movement of the switching lever 1430, which will be described in detail below.

Figure 21:
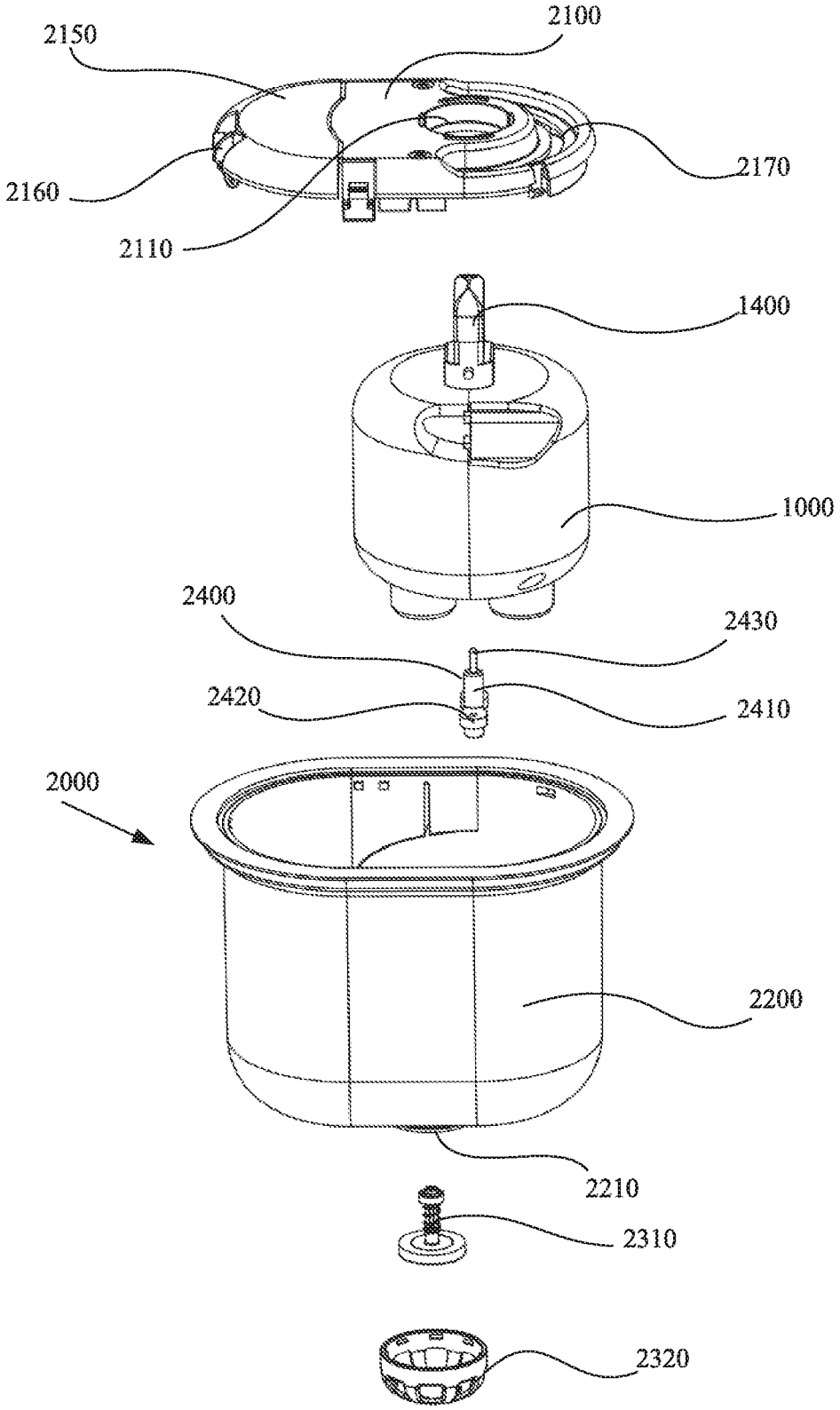
FIG. 21 is an exploded schematic diagram of the air pump illustrated in FIGS. 20*a* through 20*f* located in the shell according to another embodiment of the present invention.
Figure 22:
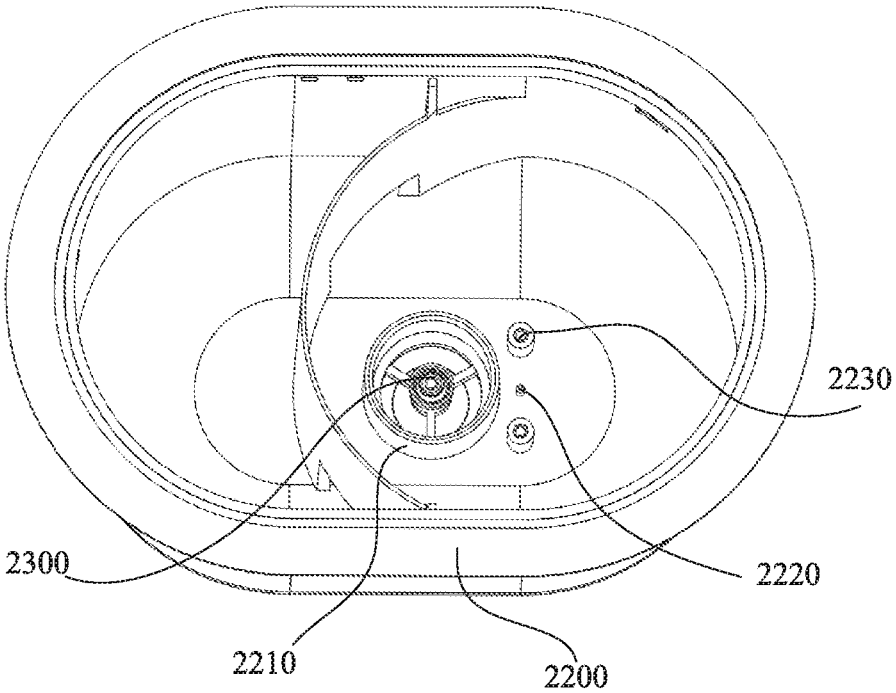
FIG. 22 is a top view of a base of the shell shown in FIG. 21 without the air pump.

FIG. 21 and FIG. 22 show an embodiment of the air pump 1000 connected to the shell 2000. In this embodiment, an upper cover 2100 and a bottom portion 2200 of the shell 2000 are detachably connected to form an internal chamber. The bottom portion 2200 is provided with a vent hole 2210, and an air valve 2300 is mounted on the vent hole 2210. The air valve 2300 may comprise a valve plug 2310 and a valve cap 2320. The air pump 1000 is detachably arranged within the bottom portion 2200 of the shell 2000 and supported by a support component 2400.

Similar to the previous embodiments, the knob switch 1400 of the air pump 1000 extends through an opening of the upper cover 2100 and out of the shell 2000. Moreover, in this embodiment, the switching lever 1430 of the air pump 1000 also extends through the opening 2170 of the upper cover 2100 and out of the shell 2000. Referring to FIG. 21, the opening 2110, 2170 of the upper cover 2100 may comprise two segments: a first segment 2110 provided for the knob switch 1400 of the air pump 1000 to extend through, and a second segment 2170 provided for the switching lever 1430 to extend through. The first segment 2110 may be provided with a limit structure to limit the knob switch 1400, and the second segment 2170 provides a movement path for the switching lever 1430 such that the air pump is switched between the first position and the second position. In this embodiment, the first pump body 1110 and the second pump body 1120 (FIG. 20*f*) are fixed integrally with the air inlet 1200 and the air outlet 1300.

It will be understood that in other embodiments, engineers may connect the pump body and the air inlet and the air outlet in a non-fixed manner for the purpose of reducing the friction area between the pump body and the bottom portion of the shell. For example, the pump body can be fixedly arranged on the shell or the bottom portion, and the air inlet and the air outlet are arranged on a circular flat plate which is rotatably connected to the pump body and fixedly connected to the knob switch. The user may then rotate the knob switch to correspondingly connect the air inlet or the air outlet to the vent hole depending on the direction of rotation. At this time, the impeller forms a partially sealed passage with the air inlet and the air outlet. In a further embodiment, the bottom of the shell or the bottom portion is partially planar. The vent hole is not provided with an air valve, but is simply provided as a port bounded by a flat portion of the shell, and the air inlet and the air outlet do not extend outwardly, and are arranged along the same plane with the bottom of the air pump. The shapes of the air inlet and the air outlet match the vent hole, and the air inlet and the air outlet 1300 are respectively connected to the vent hole in a corresponding way through rotation, so as to achieve the purposes of inflation and deflation. When the air pump is stopped, the non-air inlet/outlet position at the bottom of the air pump blocks the vent hole by rotation to form a seal. The bottom of the shell or the base can be arranged to be non-planar, so that the air inlet and the air outlet can form a gap with the bottom portion when not aligned with the vent hole, thus allowing the air flow to flow smoothly. In another embodiment, the bottom of the pump body is fixedly arranged with the pump body, such that it cannot independently move. In such instances, the bottom of the pump body may be non-planar and include a vent port. The air inlet and the air outlet are arranged on a circular flat plate inside of the air pump and are kept in fluid communication with the impeller, and the flat plate is connected to the pump body in a rotating manner and is in contact with the bottom of the pump body. Other positions of the pump body (e.g., near the knob switch) are provided with ventilation grids, which are in fluid communication with one of the air inlet and the air outlet. The air inlet and the air outlet are also not provided with convex shapes (they do not protrude outwardly from the pump body), but are arranged on a same or similar plane. The shapes of the air inlet and the air outlet match the vent port at the bottom of the pump body, and are respectively connected to the vent port at the bottom of the pump body through the rotation of the flat plate, and the vent port and the ventilation grids respectively become external air inlet/outlet ports of the air pump. The user enables the air inlet and the air outlet to rotate along with the flat plate inside the pump body by rotating the knob switch, such that the air inlet and the air outlet are respectively connected to the vent port, thus achieving the purpose of switching internal air passages. For example, when the air outlet and the vent port are correspondingly connected, the air flow enters the air inlet through the ventilation grids, and reaches the vent port from the air outlet after being pressurized by the impeller, thus realizing the inflation function. When the air inlet and the vent port are correspondingly connected, the air flow enters the air inlet through the vent port, and reaches the ventilation grids from the air outlet after being pressurized by the impeller, so as to be pumped out of the inflatable product. When the air pump is stopped, the neutral position or non-air inlet/outlet position of the flat plate blocks the vent port by rotation to form a seal. In this case, the shell can be designed as an open fixed seat, the purpose of which is only to install the pump body on the inflatable product. Similar to the above embodiment, the upper cover may be provided with an openable take-up cover, and a notch for a power line to stretch out when the take-up cover is closed.

With reference now back to FIG. 21 and FIG. 22, the support component 2400 comprises a pivot cylinder 2410 received in the internal chamber of the shell 2000 and provided with an elastic member 2440. Accordingly, a support pillar 2430 cooperating with the pivot cylinder 2410 is disposed in the internal chamber of the shell 2000, that is, on the bottom portion 2200. Referring to FIG. 21 and FIG. 22 in conjunction with FIG. 23*c*, the support component 2400 is shown to include the pivot cylinder 2410 in which an elastic member 2440 is received. One end of the elastic member 2440 may be sleeved on a positioning post 2220 formed on the bottom portion 2200, as shown in FIG. 22, while the other end abuts against the support component 2400 which is movable along the pivot cylinder 2410, and the support pillar 2430 projects from the pivot cylinder 2410 to abut against the pump body 1100 of the air pump 1000, as shown in FIG. 23*c*, thereby providing an axis for relative rotation of the pump body 1100. In some embodiments, the support component 2400 may further comprise fixing portions 2420 symmetrically disposed on side walls of the pivot cylinder 2410. Accordingly, support pillars 2230 cooperating with the fixing portions 2420 are disposed on the bottom portion 2200 of the shell 2000. Thus, the support component 2400 can effectively support the pump body 1100 of the air pump 1000, and when the pump body 1100 is moved up, the support pillar 2430 automatically resets to maintain the abutment against the pump body 1100.

It can also be seen from FIG. 23*c* that the side walls of the bottom portion 2200 of the shell 2000 can be configured to tilt gradually towards the internal chamber from the upper cover to the bottom, i.e., the walls are slightly tapered. In this way, after the pump body 1100 of the air pump 1000 is placed into the internal chamber of the shell 2000, the side walls of the shell 2000 play a certain role in positioning the pump body but do not clamp the pump body 1100.

The operation of the connected air pump according to still another embodiment of the present invention will be further described below with reference to the accompanying drawings.

FIG. 23*a* to FIG. 23*d* show the connected air pump in a stop state adjacent to the inflation position. At this position, as best shown in FIG. 23*a*, the switching lever 1430 of the air pump is located near the inflation sign 2120, and the indicator 1420 of the knob switch 1400 points to the right side. The first segment 2110 on the upper cover of the shell 2000 has an arched segment for the knob switch 1400 to rotate therein along the path. The second segment 2170 is configured in a generally semicircular form and surrounds the first segment 2110 for the switching lever 1430 to move from a position near the inflation sign 2120 to a position near the deflation sign 2130, such that the pump body is switched from the first position to the second position.

As best shown in FIG. 23*c*, in the stop state adjacent to the inflation position, the pump body 1100 of the air pump does not press the support pillar 2430 of the pivot, and the air outlet 1300 is aligned but spaced from the vent hole 2210 such that it is not yet in communication with the air valve 2310.

FIG. 24*a* to FIG. 24*d* show the connected air pump in a stop state adjacent to the deflation position. At this position, as best shown in FIG. 24*a*, the switching lever 1430 of the air pump is rotated along the second segment 2170 to the position near the deflation sign 2130, thereby driving the pump body 1100 to rotate within the internal chamber of the shell 2000. The indicator 1420 of the knob switch 1400 points to the left side. As shown in FIG. 24*c*, in this state, the pump body 1100 of the air pump does not press the support pillar 2430 of the pivot, and the air inlet 1200 is aligned with but spaced from the vent hole 2210 such that it is not yet in communication with the air valve 2310.

FIG. 25*a* to FIG. 25*e* show the connected air pump in an inflation state or inflation position. It can be seen from FIG. 25*a* that the switching lever 1430 of the air pump 1000 is still located near the inflation sign 2120, while the knob switch 1400 is rotated counterclockwise until the indicator 1420 generally points in the direction of the inflation sign 2120. In order to start the air pump 1000, during the switching of the knob switch 1400 from the stop state to the start state, the knob switch 1400 is first pressed towards the inside of the shell 2000 before rotation. As best shown in FIG. 25*b*, the edge of the first segment 2110 is extended towards the internal chamber along the transverse direction to form a vertical wall 2110*a*, and the limit structure comprises a stop flange 2111 extending out from the vertical wall 2110*a* along the path. Once the knob switch 1400 is pressed and rotated, the stop flange 2111 can restrict the knob switch 1400 in the transverse direction after it has been rotated into position. As shown in FIG. 25*d*, the protruding block 1410 on the knob switch 1400 is engaged with and retained by the stop flange 2111.

Once the air pump 1000 is an inflation state, as shown in FIG. 25*c* and FIG. 25*e*, from pressing of the knob switch 1400, the pump body 1100 in response presses the support pillar 2430 of the pivot mechanism, thereby pressing the elastic member 2440 downwardly in the transverse direction. During the movement/compression of the elastic member 2440, the air outlet 1300 moves towards the vent hole 2210 and push the valve plug 2310 to move down to open the vent hole 2210. Thus, as indicated by the arrows in FIG. 25*e*, an inflation path is formed in the connected air pump 1000. More particularly, the air flow enters the shell 2000 from the first segment 2110 or the second segment 2170 of the upper cover 2100 and then enters the air inlet cavity of the pump body 1100 along the air inlet 1200 of the air pump 1000, whereafter it flows into the air outlet cavity, and then enters the inflatable product 500 via the air outlet 1300 and finally the vent hole 2210 to effect inflation.

Further, when the knob switch 1400 is rotated in the opposite direction, i.e., clockwise, the elastic member 2440 is released from the restriction of the protruding block 1410 by stop flange 2111 and becomes elastically reset, resulting in the support pillar 2430 and the pump body 1110 being ejected towards the outside of the shell 2000 along the transverse direction, thereby restoring to the stop state shown in 23*a*.

FIG. 26*a* to FIG. 26*e* show the connected air pump in the deflation state or the deflation position. It can be seen from FIG. 26*a* that the switching lever 1430 of the air pump 1000 is still located near the deflation sign 2130, while the knob switch 1400 is rotated counterclockwise until the indicator 1420 generally points in the direction of the deflation sign 2130. As such, when the air pump 1000 is started, the knob switch 1400 is pressed down towards the inside of the shell 2000, then rotated along the first segment 2110, and retained by the stop flange 2111, so that the air pump 1000 is in a deflation state.

As shown in FIG. 26*c* and FIG. 26*e*, due to the pressing of the knob switch 1400 downwardly along the transverse direction, the pump body 1100 of the air pump 1000 presses the support pillar 2430 of the pivot, thereby pressing the elastic member 2440. During the movement/compression of the elastic member 2440 the air inlet 1200 is moved towards the vent hole 2210 and pushes the valve plug 2310 to move down to open the vent hole 2210. Thus, as indicated by the arrows in FIG. 26*e*, a deflation path is formed in the connected air pump 1000. In the deflation path, the air flow enters the shell 2000 from the inflatable product 500 via the vent hole 2210, enters the air inlet cavity of the pump body 1100 along the air inlet 1200 of the air pump 1000, flows into the air outlet cavity, and then flows out of the shell 2000 from the first segment 2110/the second segment 2170 of the upper cover 2100 to effect deflation.

FIGS. 27*a* and FIG. 27*b* show the air pump 1000 connected to an inflatable product such as a mattress 500. Similar to FIG. 15*a* and FIG. 15*b*, the air pump 1000 in the connected air pump 1000 can be detached from the bottom portion 2200 and taken out to independently serve the inflation or deflation functionality.

It can be seen from the above summary that in the inflatable product of the present invention, the air pump can be switched between inflation and deflation by means of mechanized operation of the knob switch. This arrangement simplifies the operation and the internal structure of the air pump because it does not require a traditional air passage switching device, thus also saving on the production costs. Further, the air pump may be used even when it is detached from the shell. When the air pump is connected, the inflatable product can be quickly and effectively inflated and deflated by the structural cooperation between the knob switch of the air pump and the opening of the upper cover of the shell, so that the user experience is further simplified and improved. Compared with the existing air pump, the present invention can be used as a connected air pump or detached, external air pump according to different needs, thus being more widely applicable to various inflatable products, and having significant cost effectiveness and replaceability.

It should be understood that the embodiments shown in the FIGS. only show example shapes, dimensions, and arrangements of the inflatable product and the air pump according to the present invention, which are merely illustrative but not restrictive. It should be appreciated that other shapes, dimensions, and arrangements may be employed without departing from the spirit and scope of the present invention.

The technical content and technical features of the present invention are disclosed above, but it could be understood that those skilled in the art may make variations and improvements to the concepts disclosed above under the inventive concepts of the present invention, and all the variations and improvements fall into the scope of the present invention. The scope of the present invention shall be defined by the claims.

Although multiple embodiments have been described herein, various modifications may be made to these embodiments without departing from the spirit of the invention, and all such modifications still belong to the concept of the present invention and fall within the scope of the claims of the present invention. The scope of protection is only limited by the scope of the accompanying claims.

The disclosed systems and methods of operation are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended by the details of construction or design herein shown, other than as described in the claims below. It is therefore evident that the particular illustrative implementations disclosed above may be altered, combined, or modified and all such variations are considered within the scope of the present disclosure. The systems and methods of operation illustratively disclosed herein may suitably be practiced in the absence of any element that is not specifically disclosed herein and/or any optional element disclosed herein. The terms in the claims have their plain, ordinary meaning unless otherwise explicitly and clearly defined in the specification. Moreover, the indefinite articles "a" or "an," as used in the claims, are defined herein to mean one or more than one of the element that it introduces. If there is any conflict in the usages of a word or term in this specification and one or more patents or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" includes at least one of any one of the items, and/or at least one of any combination of the items, and/or at least one of each of the items. By way of example, the phrases "at least one of A, B, and C" or "at least one of A, B, or C" each refer to only A, only B, or only C. Claim recitations of "first" or "second" are not necessarily limited to usage in the specification unless otherwise supported within the claim terminology. The various features described in reference to specific embodiments can be arranged with other embodiments without departing from the subject disclosure.

What is claimed is:

1. An inflatable product, comprising:

a side wall defining an inflation cell;

a shell located on the side wall and extending into the inflation cell, the shell defining an internal chamber and an air valve, the air valve being in fluid communication with the internal chamber and the inflation cell, the shell comprising a cover defining an opening; and an air pump comprising an air inlet and an air outlet, the air pump being moveably located at least partially within the internal chamber; and a knob switch extending from the pump body through the opening;

wherein the knob switch is moveable along a path extending in a first direction within the opening, such that movement of the knob switch causes the air pump to move along the path within the internal chamber among:

a first position, in which the air inlet is adjacent to the air valve;

a second position, in which the air outlet is adjacent to the air valve; and a neutral position, in which neither the air inlet nor the air outlet are adjacent to the air valve; and wherein the knob switch is further moveable in a transverse direction, transverse to the path, such that movement of the knob switch in the transverse direction causes the air pump to move in the transverse direction to connect the air inlet to the air valve in the first position and to connect the air outlet to the air valve in the second position.

2. The inflatable product according to claim 1, wherein the opening is bounded by at least a first segment and a second segment, the knob switch being movable along the path between the first segment and the second segment;

wherein the shell further comprises a limit structure configured to retain the knob switch and pump body in one of the first position and the second position and to prevent movement of the knob switch and the pump body along the transverse direction; and wherein when the knob switch is engaged with the limit structure, the limit structure retains the knob switch and the pump body in one of the first position and the second position.

3. The inflatable product according to claim 2, wherein the opening is further bounded by a third segment, and the knob switch is moveable along the path among the first segment, the second segment, and the third segment, the air inlet and the air outlet being misaligned from the air valve in the transverse direction when at least part of the knob switch is located in a portion of the opening bounded by the third segment.

4. The inflatable product according to claim 2, further comprising a vertical wall extending from an edge of the first segment and an edge of the second segment into the internal chamber, wherein the limit structure comprises a first guide rail located on the vertical wall adjacent to the first segment and extending obliquely from a starting end to a terminating end towards an inside of the shell, and a second guide rail located on the vertical wall adjacent to the second segment and extending obliquely from a starting end to a terminating end towards the inside of the shell;

wherein the knob switch comprises a protruding block engaging with one of the first guide rail and the second guide rail during rotation of the knob switch to further retain the knob switch and the pump body along the transverse direction in one of the first position and the second position.

5. The inflatable product according to claim 2, further comprising a vertical wall extending from an edge of the first segment and an edge of the second segment into the internal chamber, wherein the limit structure comprises a flange located on the vertical wall and extending obliquely from a starting end to a terminating end towards an inside of the shell, and wherein the knob switch comprises a sliding groove engaged with the flange during a rotation of the knob switch to further retain the knob switch and the pump body along the transverse direction in one of the first position and the second position.

6. The inflatable product according to claim 2, wherein the limit structure comprises a limit plate extending along the first segment and the second segment, and the knob switch comprises a clamping groove engaging with the limit plate to retain the knob switch and the pump body in one of the first position and the second position.

7. The inflatable product according to claim 1, wherein the opening in the cover is bounded by a first segment and a second segment and a vertical wall extending from an edge of the first segment into the internal chamber; and wherein the shell further comprises a limit structure located on the vertical wall and comprising a stop flange; and wherein the knob switch comprises a protruding block engaging with the stop flange to retain the knob switch and the pump body in one of the first position and the second position.

8. The inflatable product according to claim 1, wherein the opening in the cover is bounded by at least a first segment and a second segment, the second segment defining an arc shape; and wherein the pump body comprises a switching lever extending through a portion of the opening bounded by the second segment, and moveable along the second segment to align one of the air inlet and the air outlet with the air valve.

9. The inflatable product according to claim 1, further comprising:

a support component located in the internal chamber of the shell and supporting the air pump in the transverse direction, wherein as the air pump is moved towards the air valve along the transverse direction, the pump body presses the support component to move towards the air valve, and as the air pump is moved away from the air valve along the transverse direction, the support component biases the air pump away from the air valve.

10. The inflatable product according to claim 9, wherein the support component comprises a base supporting at least one of the air inlet and the air outlet, the base defining at least one notch corresponding to the air valve of the shell and a plurality of bosses located opposite from the air pump, wherein each boss of the plurality of bosses comprises an elastic member sleeved therearound, and wherein the support component further comprises a wall plate that extends perpendicularly from an edge of the base.

11. The inflatable product according to claim 9, wherein the support component comprises a pivot comprising an elastic member, the pivot supporting the pump body in the internal chamber, and wherein the shell comprises a support pillar pivotably connected to the pivot.

12. The inflatable product according to claim 9, wherein the support component comprises a base extending between a pair of first opposing edges of the base and configured to support at least one of the air inlet and the air outlet, the base defining at least one notch corresponding to the air valve, wherein a support plate extends from each edge of the pair of first opposing edges, and wherein the support plates extend along the pump body towards the knob switch.

13. The inflatable product according to claim 12, wherein the pump body comprises a pair of convex strips protruding from opposing sides of an outer side wall of the pump body, and wherein each convex strip of the pair of convex strips abuts against a corresponding support plate.

14. The inflatable product according to claim 12, wherein each support plate defines a grid.

15. The inflatable product according to claim 12, wherein the base further extends between a pair of opposing second edges of the base, wherein the support component further comprises a plurality of wall plates comprising a wall plate extending perpendicularly from each edge of the pair of opposing second edges towards the pump body, and wherein each of the plurality of wall plates is arranged alternately with the support plates.

16. The inflatable product according to claim 15, wherein the pump body comprises a bottom surface facing the air valve and at least one of the plurality of wall plates abuts against the bottom surface when the air pump is in one of the first position and the second position.

17. The inflatable product according to claim 12, wherein the base comprises a plurality of fixing holes and a plurality of bosses, each boss of the plurality of bosses being sleeved with an elastic member and mated with a fixing hole of the plurality of fixing holes.

18. The inflatable product according to claim 1, wherein the air inlet and the air outlet are located on a same plane.

* * * * *